US006659177B2

(12) United States Patent
Bolze et al.

(10) Patent No.: US 6,659,177 B2
(45) Date of Patent: Dec. 9, 2003

(54) REDUCED CONTAMINATION SAMPLING

(75) Inventors: Victor M. Bolze, Houston, TX (US); Jonathan Brown, Dunecht (GB); Andrew Kurkjian, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 09/960,570

(22) Filed: Sep. 20, 2001

(65) Prior Publication Data

US 2002/0084072 A1 Jul. 4, 2002

Related U.S. Application Data

(63) Continuation-in-part of application No. 09/712,373, filed on Nov. 14, 2000.

(51) Int. Cl.[7] ..... E21B 49/08; E21B 49/10

(52) U.S. Cl. ..... 166/264; 166/167; 175/59

(58) Field of Search ..... 166/264, 163, 166/165, 167; 175/20, 58, 59

(56) References Cited

U.S. PATENT DOCUMENTS

| | | | | |
|---|---|---|---|---|
| 3,385,364 | A | | 5/1968 | Whitten |
| 3,859,850 | A | * | 1/1975 | Whitten et al. ..... 73/152.24 |
| 3,969,937 | A | | 7/1976 | Barrington et al. |
| 4,434,653 | A | | 3/1984 | Montgomery |
| 4,703,799 | A | | 11/1987 | Jennings, Jr. et al. |
| 4,745,802 | A | | 5/1988 | Purfurst |
| 4,860,581 | A | | 8/1989 | Zimmerman et al. |
| 4,879,900 | A | | 11/1989 | Gilbert |
| 4,936,139 | A | | 6/1990 | Zimmerman et al. |
| 4,994,671 | A | | 2/1991 | Safinya et al. |
| 5,056,595 | A | | 10/1991 | Desbrandes |
| 5,166,747 | A | | 11/1992 | Schroeder et al. |
| 5,269,180 | A | | 12/1993 | Dave et al. |
| 5,303,775 | A | | 4/1994 | Michaels et al. |
| 5,337,822 | A | | 8/1994 | Massie et al. |
| 5,377,755 | A | | 1/1995 | Michaels et al. |
| 5,609,205 | A | | 3/1997 | Massie et al. |
| 5,644,076 | A | | 7/1997 | Proett et al. |
| 5,662,166 | A | | 9/1997 | Shammai |
| 5,890,549 | A | | 4/1999 | Sprehe |
| 5,901,788 | A | | 5/1999 | Brown et al. |
| 5,934,374 | A | | 8/1999 | Hrametz et al. |
| 5,939,717 | A | | 8/1999 | Mullins |
| 5,956,132 | A | | 9/1999 | Donzier |
| 6,216,804 | B1 | | 4/2001 | Aumann et al. |
| 6,328,103 | B1 | | 12/2001 | Pahmiyer et al. |
| 6,378,631 | B1 | | 4/2002 | Aumann et al. |

FOREIGN PATENT DOCUMENTS

EP 0 791 723 A1 8/1997

OTHER PUBLICATIONS

Crocker, H. et al., An Improved Wireline Formation Fluid Sampler and Tester, Society of Petroleum Engineers SPE 22971, Nov. 4–7, 1991, pp. 237–244.

Neville, Norman, RFT Backflush Solves Probe–Plugging Problem, Technical Review, vol. 26, No. 4, pp. 15–20.

* cited by examiner

*Primary Examiner*—David Bagnell
*Assistant Examiner*—Jennifer H. Gay
(74) *Attorney, Agent, or Firm*—J. L. Jennie Salazar; Brigitte L. Jeffery; John Ryberg

(57) ABSTRACT

A sample module for use in a downhole tool includes a sample chamber for receiving and storing pressurized fluid. A piston is slidably disposed in the chamber to define a sample cavity and a buffer cavity, and the cavities have variable volumes determined by movement of the piston. A first flowline is provided for communicating fluid obtained from a subsurface formation through the sample module. A second flowline connects the first flowline to the sample cavity, and a third flowline connects the first flowline to the buffer cavity for communicating buffer fluid out of the buffer cavity. A first valve capable of moving between a closed position and an open position is disposed in the second flowline for communicating flow of fluid from the first flowline to the sample cavity. When the first valve is in the open position, the sample cavity and the buffer cavity are in fluid communication with the first flowline and therefore have equivalent pressures.

65 Claims, 10 Drawing Sheets

140
134
GM
132
110p
54
110c
120
122
118

132
54
110c
120
122
118

132
110p
54
110c
120
122
118

140p
140
140c
134
GM
126
130
132
124
110p
54
112
110c
54
120
122
118
128
From Reservoir

REDUCED CONTAMINATION SAMPLING

CROSS-REFERENCE TO RELATED APPLICATIONS

The present application is a continuation-in-part of application Ser. No. 09/712,373 filed on Nov. 14, 2000, the contents of which are hereby incorporated by reference in their entirety.

BACKGROUND OF THE INVENTION

1. Field of the Invention

This invention relates generally to formation fluid sampling, and more specifically to an improved formation fluid sampling module, the purpose of which is to bring high quality formation fluid samples to the surface for analysis, in part, by eliminating the "dead volume" which exists between a sample chamber and the valves which seal the sample chamber in the sampling module.

2. Description of the Related Art

The desirability of taking downhole formation fluid samples for chemical and physical analysis has long been recognized by oil companies, and such sampling has been performed by the assignee of the present invention, Schlumberger, for many years. Samples of formation fluid, also known as reservoir fluid, are typically collected as early as possible in the life of a reservoir for analysis at the surface and, more particularly, in specialized laboratories. The information that such analysis provides is vital in the planning and development of hydrocarbon reservoirs, as well as in the assessment of a reservoir's capacity and performance.

The process of wellbore sampling involves the lowering of a sampling tool, such as the MDT™ formation testing tool, owned and provided by Schlumberger, into the wellbore to collect a sample or multiple samples of formation fluid by engagement between a probe member of the sampling tool and the wall of the wellbore. The sampling tool creates a pressure differential across such engagement to induce formation fluid flow into one or more sample chambers within the sampling tool. This and similar processes are described in U.S. Pat. Nos. 4,860,581; 4,936,139 (both assigned to Schlumberger); U.S. Pat. Nos. 5,303,775; 5,377,755 (both assigned to Western Atlas); and U.S. Pat. No. 5,934,374 (assigned to Halliburton).

The desirability of housing at least one, and often a plurality, of such sample chambers, with associated valving and flow line connections, within "sample modules" is also known, and has been utilized to particular advantage in Schlumberger's MDT tool. Schlumberger currently has several types of such sample modules and sample chambers, each of which provide certain advantages for certain conditions.

"Dead volume" is a phrase used to indicate the volume that exits between the seal valve at the inlet to a sample cavity of a sample chamber and the sample cavity itself. In operation, this volume, along with the rest of the flow system in a sample chamber or chambers, is typically filled with a fluid, gas, or a vacuum (typically air below atmospheric pressure), although a vacuum is undesirable in many instances because it allows a large pressure drop when the seal valve is opened. Thus, many high quality samples are now taken using "low shock" techniques wherein the dead volume is almost always filled with a fluid, usually water. In any case, whatever is used to fill this dead volume is swept into and captured in the formation fluid sample when the sample is collected, thereby contaminating the sample.

The problem is illustrated in FIG. 1, which shows sample chamber 10 connected to flow line 9 via secondary line 11. Fluid flow from flow line 9 into secondary line 11 is controlled by manual shut-off valve 17 and surface-controllable seal valve 15. Manual shut-off valve 17 is typically opened at the surface prior to lowering the tool containing sample chamber 10 into a borehole (not shown in FIG. 1), and then shut at the surface to positively seal a collected fluid sample after the tool containing sample chamber 10 is withdrawn from the borehole. Thus, the admission of formation fluid from flow line 9 into sample chamber 10 is essentially controlled by opening and closing seal valve 16 via an electronic command delivered from the surface through an armored cable known as a "wireline," as is well known in the art. The problem with such sample fluid collection is that dead volume fluid DV is collected in sample chamber 10 along with the formation fluid delivered through flow line 9, thereby contaminating the fluid sample. To date, there are no known sample chambers or modules that address this problem of contamination resulting from dead volume collection in a fluid sample.

The present invention is directed to a method and apparatus that may solve or at least reduce, some or all of the problems described above.

SUMMARY OF THE INVENTION

In one illustrated embodiment, the present invention is directed to a sample module for use in a tool adapted for insertion into a subsurface wellbore for obtaining fluid samples. The sample module comprises a sample chamber for receiving and storing pressurized fluid. A piston is slidably disposed in the sample chamber and defines a sample cavity and a buffer cavity, the cavities having variable volumes determined by movement of the piston. A first flowline provides for communicating fluid obtained from a subsurface formation through the sample module. A second flowline connects the first flowline to the sample cavity. A third flowline connects the first flowline to the buffer cavity of the sample chamber for communicating buffer fluid out of the buffer cavity. A first valve capable of moving between a closed position and an open position is disposed in the second flowline for communicating flow of fluid from the first flowline to the sample cavity. When the first valve is in the open position, the sample cavity and the buffer cavity are in fluid communication with the first flowline and therefore have approximately equivalent pressures.

The sample module can further comprise a second valve disposed in the first flowline between the second flowline and the third flowline, and the second flowline can be connected to the first flowline upstream of said second valve. The third flowline can be connected to the first flowline downstream of the second valve. There can also be a fourth flowline connected to the sample cavity of the sample chamber for communicating fluid out of the sample cavity. The fourth flowline can also be connected to the first flowline, whereby fluid preloaded in the sample cavity may be flushed out using formation fluid via the fourth flowline. In one particular embodiment, the fourth flowline is connected to the first flowline downstream of the second valve. A third valve can be disposed in the fourth flowline for controlling the flow of fluid through the fourth flowline. The sample module can be a wireline-conveyed formation testing tool. In exemplary embodiments of the invention the sample cavity and the buffer cavity have a pressure differential between them that is less than 50 psi. In other exemplary embodiments of the invention, the sample cavity and the buffer cavity have a pressure differential between them that is less than 25 psi and less than 5 psi.

An alternate embodiment comprises a sample module for obtaining fluid samples from a subsurface wellbore. The sample module comprising a sample chamber for receiving and storing pressurized fluid with a piston movably disposed in the chamber defining a sample cavity and a buffer cavity, the cavities having variable volumes determined by movement of the piston. A first flowline for communicating fluid obtained from a subsurface formation proceeds through the sample module along with a second flowline connecting the first flowline to the sample cavity. A third flowline is connects the first flowline to the buffer cavity of the sample chamber for communicating buffer fluid out of the buffer cavity. A first valve capable of moving between a closed position and an open position is disposed in the second flowline for communicating flow of fluid from the first flowline to the sample cavity. A second valve capable of moving between a closed position and an open position is disposed in the first flowline between the second flowline and the third flowline. When the first valve and the second valve are in the open position, the sample cavity and the buffer cavity are in fluid communication with the first flowline and therefore have approximately equivalent pressures. The sample cavity and the buffer cavity can have a pressure differential between them that is less than 50 psi, less than 25 psi or less than 5 psi.

In another embodiment, the invention is directed to an apparatus for obtaining fluid from a subsurface formation penetrated by a wellbore. The apparatus comprises a probe assembly for establishing fluid communication between the apparatus and the formation when the apparatus is positioned in the wellbore. A pump assembly is capable of drawing fluid from the formation into the apparatus via the probe assembly. A sample module is capable of collecting a sample of the formation fluid drawn from the formation by the pumping assembly. The sample module comprises a chamber for receiving and storing fluid and a piston slidably disposed in the chamber to define a sample cavity and a buffer cavity, the cavities having variable volumes determined by movement of the piston. A first flowline is in fluid communication with the pump assembly for communicating fluid obtained from the formation through the sample module. A second flowline connects the first flowline to the sample cavity and a first valve is disposed in the second flowline for controlling the flow of fluid from said first flowline to the sample cavity. When the first valve is in the open position, the sample cavity and the buffer cavity are in fluid communication with the first flowline and thereby have approximately equivalent pressures.

The apparatus can further comprise a second valve disposed in the first flowline between the second flowline and the third flowline. The second flowline can be connected to the first flowline upstream of the second valve, while the third flowline can be connected to the first flowline downstream of the second valve. A fourth flowline can be connected to the sample cavity of the sample chamber for communicating fluid into and out of the sample cavity. The fourth flowline can also be connected to the first flowline, whereby any fluid preloaded in the sample cavity can be flushed out using formation fluid via the fourth flowline. The fourth flowline can be connected to the first flowline downstream of the second valve and can comprise a third valve controlling the flow of fluid through the fourth flowline. The apparatus can be a wireline-conveyed formation testing tool.

The inventive apparatus is typically a wireline-conveyed formation testing tool, although the advantages of the present invention are also applicable to a logging-while-drilling (LWD) tool such as a formation tested carried in a drillstring. The pressure differential between the sample cavity and the buffer cavity can be less than 50 psi, less than 25 psi or less than 5 psi.

Yet another embodiment of the present invention can comprise a method for obtaining fluid from a subsurface formation penetrated by a wellbore. The method comprises positioning a formation testing apparatus within the wellbore, the testing apparatus comprising a sample chamber having a floating piston slidably positioned therein, so as to define a sample cavity and a buffer cavity. Fluid communication is established between the apparatus and the formation and movement of fluid from the formation through a first flowline in the apparatus is induced with a pump located downstream of the first flowline. Communication between the sample cavity and the first flowline, and between the buffer cavity and the first flowline are established whereby the sample cavity, buffer cavity and the first flowline have equivalent pressures. Buffer fluid is removed from the buffer cavity, thereby moving the piston within the sample chamber and delivering a sample of the formation fluid into the sample cavity of a sample chamber. The apparatus is then withdrawn from the wellbore to recover the collected sample.

The method can further comprise flushing out at least a portion of a fluid precharging the sample cavity by inducing movement of at least a portion of the formation fluid though the sample cavity and collecting a sample of the formation fluid within the sample cavity after the flushing step. The flushing step can be accomplished with flow lines leading into and out of the sample cavity. Each of the flow lines can be equipped with a seal valve for controlling fluid flow therethrough. The flushing step can include flushing the precharging fluid out to the borehole or into a primary flow line within the apparatus. The method can further comprise the step of maintaining the sample collected in the sample cavity in a single phase condition as the apparatus is withdrawn from the wellbore.

In one particular embodiment the formation fluid is drawn into the sample cavity by movement of the piston as the buffer fluid is withdrawn from the buffer cavity and the expelled buffer fluid is delivered to a primary flow line within the apparatus. The pressure differential between the sample cavity and the first flowline can be less than 50 psi, less than 25 psi, or less than 5 psi. The fluid movement from the formation into the apparatus can be induced by a probe assembly engaging the wall of the formation, and a pump assembly that is in fluid communication with the probe assembly, both assemblies being within the apparatus.

BRIEF DESCRIPTION OF THE DRAWINGS

The manner in which the present invention attains the above recited features, advantages, and objects can be understood with greater clarity by reference to the preferred embodiments thereof that are illustrated in the accompanying drawings.

It is to be noted however, that the appended drawings illustrate only typical embodiments of this invention and are therefore not to be considered limiting of its scope, for the invention may admit to other equally effective embodiments.

In the drawings:

FIG. 1 is a simplified schematic of a prior art sample module, illustrating the problem of dead volume contamination;

FIGS. 2 and 3 are schematic illustrations of a prior art formation testing apparatus and its various modular components;

Figure 5B:
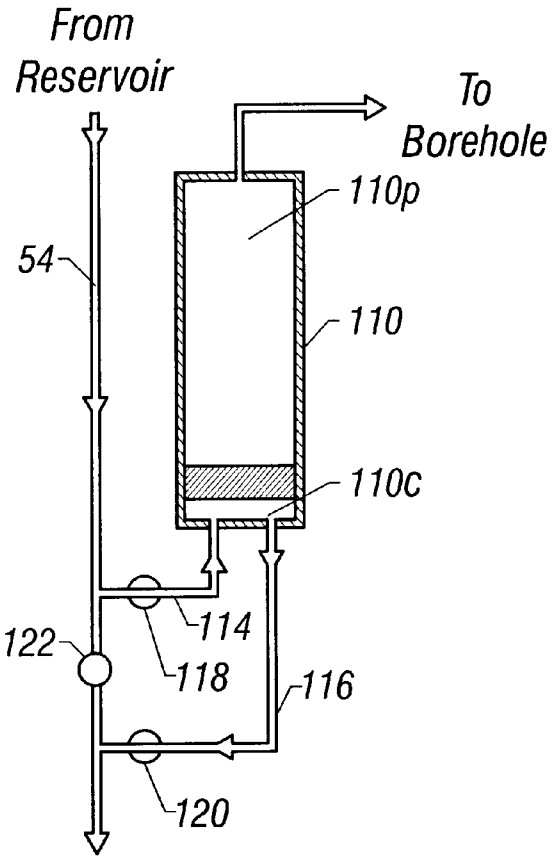
Figure 5A:
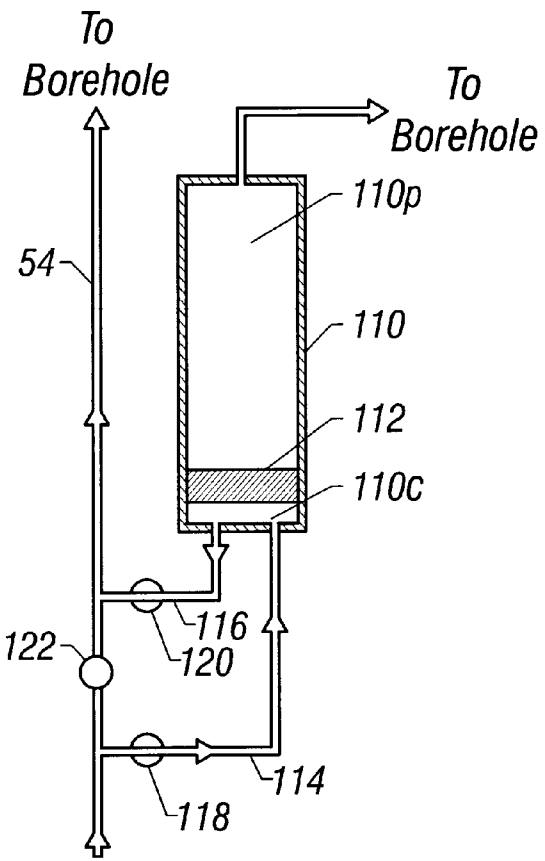

FIGS. 4A–D are sequential, schematic illustrations of a sample module incorporating dead volume flushing according to an embodiment of the present invention;

FIGS. 5A–B are schematic illustrations of sample modules according to an embodiment of the present invention having alternative flow orientations;

FIGS. 6A–D are sequential, schematic illustrations of a sample module according to an embodiment of the present invention wherein buffer fluid is expelled back into the primary flowline as a sample is collected in a sample chamber;

FIGS. 7A–D are sequential, schematic illustrations of a sample module according to an embodiment of the present invention wherein a pump is utilized to draw buffer fluid and thereby induce formation fluid into the sample chamber;

FIGS. 8A–D are sequential, schematic illustrations of a sample module according to an embodiment of the present invention equipped with a gas charge module;

FIGS. 9A–D are sequential, schematic illustrations of a sample module according to an embodiment of the present invention wherein a pump is utilized to draw buffer fluid and thereby induce formation fluid into the sample chamber;

FIGS. 10A–D are sequential, schematic illustrations of a sample module according to an embodiment of the present invention wherein a pump is utilized to draw buffer fluid and thereby induce formation fluid into the sample chamber.

DETAILED DESCRIPTION OF THE INVENTION

Figure 1:
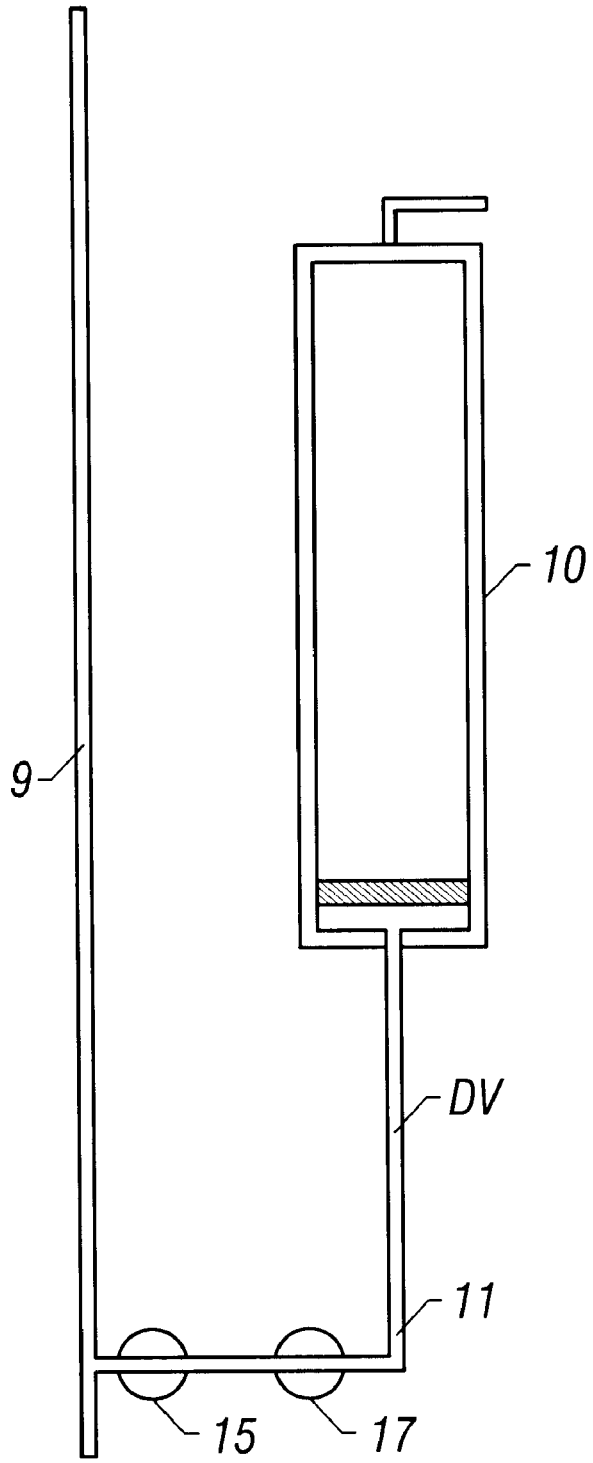
FIG. 1 (Prior Art)

FIG. 1 illustrates a simplified schematic of a prior art sample module 10, illustrating how fluid from flowline 12 can be routed through flowline 14 and two valves 16, 18 and enter the sample module 10. In this embodiment there is a dead volume DV that is not capable of being flushed out and can therefore contaminate any sample fluid collected within the sample module 10. In addition the fluid sample collected may be subject to pressure changes during the sampling operation that can alter the fluid properties.

Figure 2:
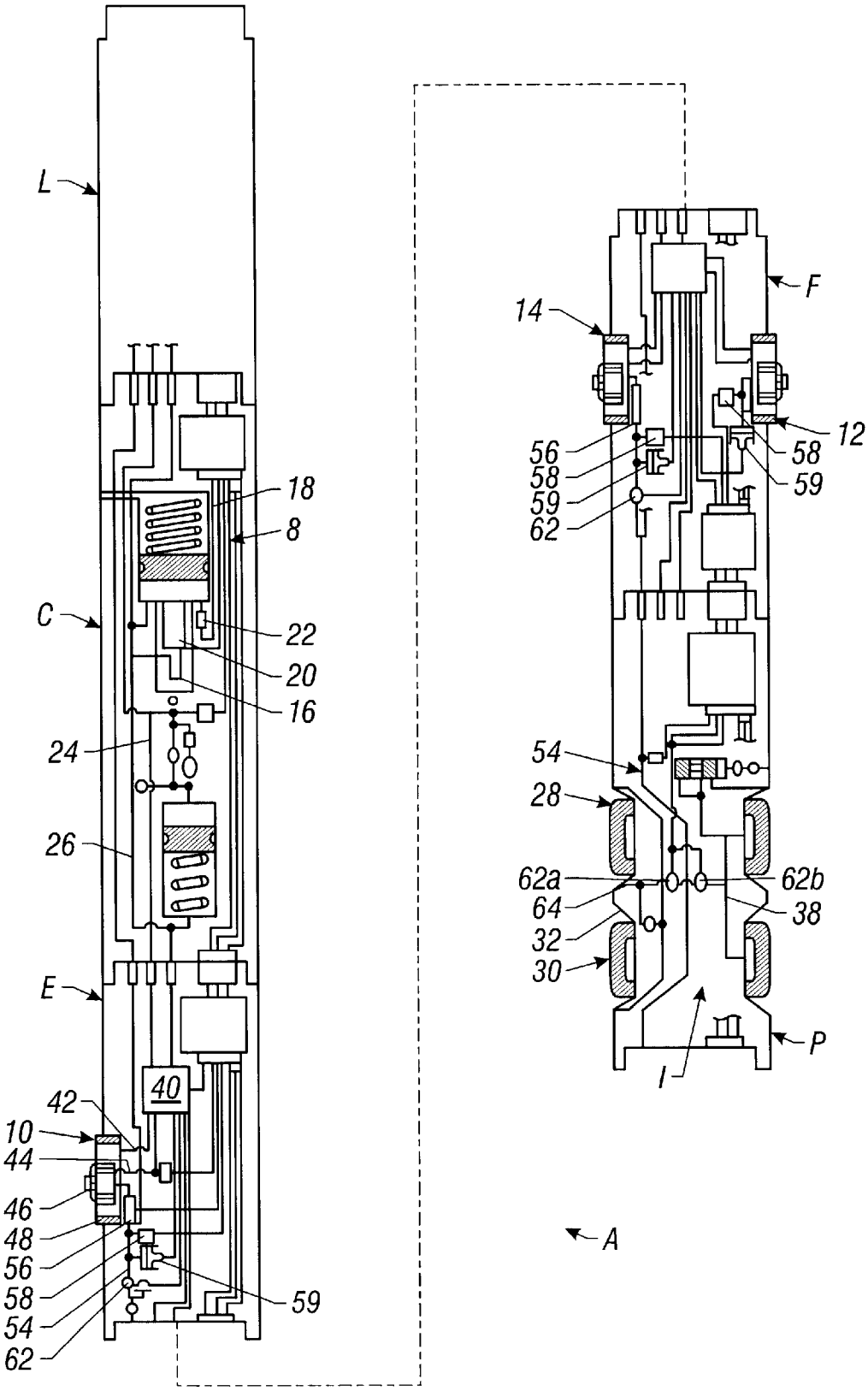
FIG. 2 (Prior Art)
Figure 3:
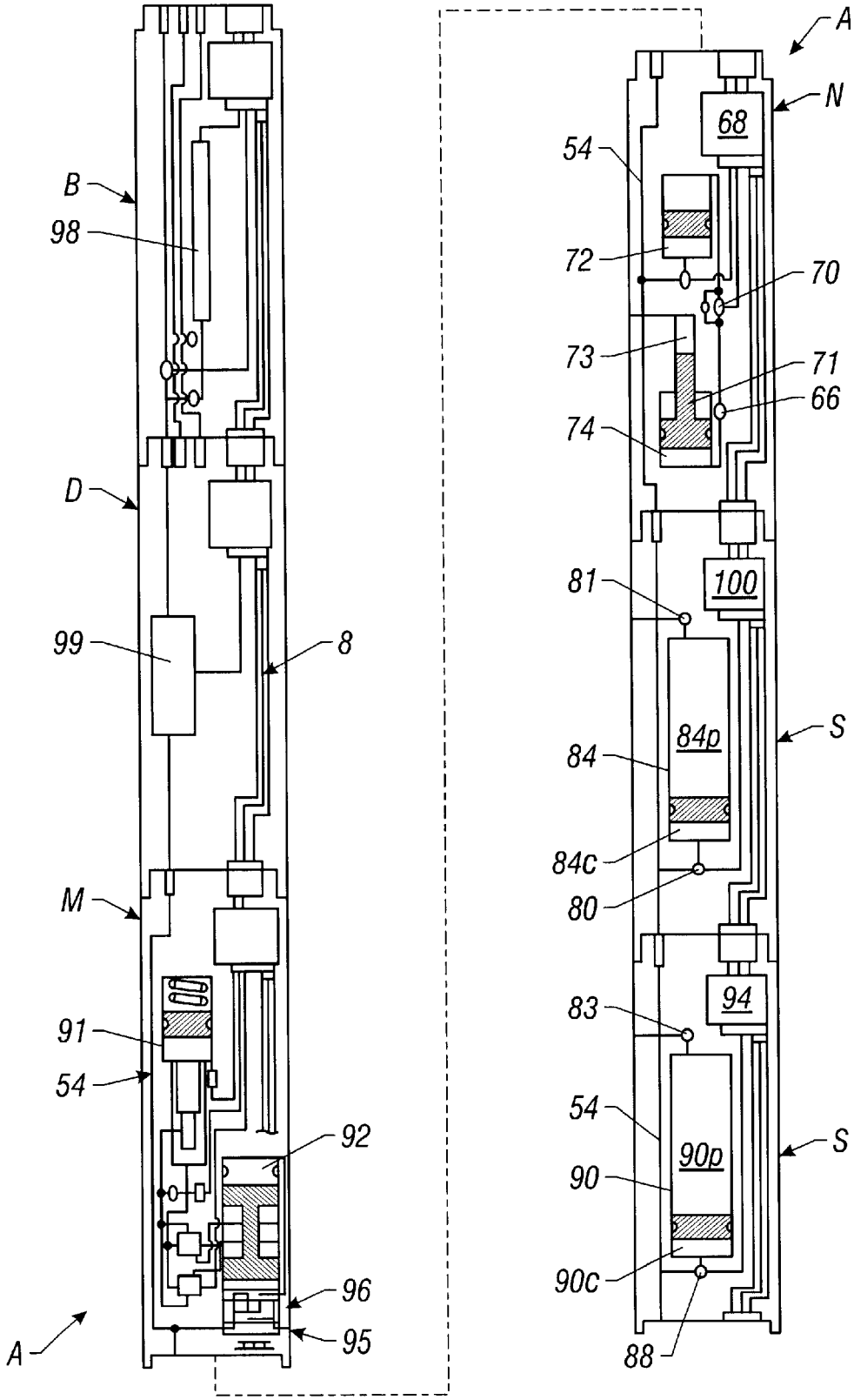
FIG. 3 (Prior Art)

Turning now to prior art FIGS. 2 and 3, an apparatus with which the present invention may be used to advantage is illustrated schematically. The apparatus A of FIGS. 2 and 3 is of modular construction, although a unitary tool is also useful. The apparatus A is a down hole tool which can be lowered into the well bore (not shown) by a wire line (not shown) for the purpose of conducting formation property tests. A presently available embodiment of such a tool is the MDT (trademark of Schlumberger) tool. The wire line connections to tool A as well as power supply and communications-related electronics are not illustrated for the purpose of clarity. The power and communication lines that extend throughout the length of the tool are generally shown at 8. These power supply and communication components are known to those skilled in the art and have been in commercial use in the past. This type of control equipment would normally be installed at the uppermost end of the tool adjacent the wire line connection to the tool with electrical lines running through the tool to the various components.

As shown in the embodiment of FIG. 2, the apparatus A has a hydraulic power module C, a packer module P, and a probe module E. Probe module E is shown with one probe assembly 10 which may be used for permeability tests or fluid sampling. When using the tool to determine anisotropic permeability and the vertical reservoir structure according to known techniques, a multiprobe module F can be added to probe module E, as shown in FIG. 2. Multiprobe module F has sink probe assemblies 12 and 14.

The hydraulic power module C includes pump 16, reservoir 18, and motor 20 to control the operation of the pump 16. Low oil switch 22 also forms part of the control system and is used in regulating the operation of the pump 16.

The hydraulic fluid line 24 is connected to the discharge of the pump 16 and runs through hydraulic power module C and into adjacent modules for use as a hydraulic power source. In the embodiment shown in FIG. 2, the hydraulic fluid line 24 extends through the hydraulic power module C into the probe modules E and/or F depending upon which configuration is used. The hydraulic loop is closed by virtue of the hydraulic fluid return line 26, which in FIG. 2 extends from the probe module E back to the hydraulic power module C where it terminates at the reservoir 18.

The pump-out module M, seen in FIG. 3, can be used to dispose of unwanted samples by virtue of pumping fluid through the flow line 54 into the borehole, or may be used to pump fluids from the borehole into the flow line 54 to inflate the straddle packers 28 and 30. Furthermore, pump-out module M may be used to draw formation fluid from the wellbore via the probe module E or F, and then pump the formation fluid into the sample chamber module S against a buffer fluid therein. This process will be described further below.

The bi-directional piston pump 92, energized by hydraulic fluid from the pump 91, can be aligned to draw from the flow line 54 and dispose of the unwanted sample though flow line 95, or it may be aligned to pump fluid from the borehole (via flow line 95) to flow line 54. The pumpout module can also be configured where flowline 95 connects to the flowline 54 such that fluid may be drawn from the downstream portion of flowline 54 and pumped upstream or vice versa. The pump out module M has the necessary control devices to regulate the piston pump 92 and align the fluid line 54 with fluid line 95 to accomplish the pump out procedure. It should be noted here that piston pump 92 can be used to pump samples into the sample chamber module(s) S, including overpressuring such samples as desired, as well as to pump samples out of sample chamber module(s) S using the pump-out module M. The pump-out module M may also be used to accomplish constant pressure or constant rate injection if necessary. With sufficient power, the pump out module M may be used to inject fluid at high enough rates so as to enable creation of microfractures for stress measurement of the formation.

Alternatively, the straddle packers 28 and 30 shown in FIG. 2 can be inflated and deflated with borehole fluid using the piston pump 92. As can be readily seen, selective actuation of the pump-out module M to activate the piston pump 92, combined with selective operation of the control valve 96 and inflation and deflation of the valves I, can result in selective inflation or deflation of the packers 28 and 30. Packers 28 and 30 are mounted to outer periphery 32 of the apparatus A, and may be constructed of a resilient material compatible with wellbore fluids and temperatures. The packers 28 and 30 have a cavity therein. When the piston pump 92 is operational and the inflation valves I are properly set, fluid from the flow line 54 passes through the inflation/deflation valves I, and through the flow line 38 to the packers 28 and 30.

As also shown in FIG. 2, the probe module E has a probe assembly 10 that is selectively movable with respect to the apparatus A. Movement of the probe assembly 10 is initiated by operation of a probe actuator 40, which aligns the hydraulic flow lines 24 and 26 with the flow lines 42 and 44. The probe 46 is mounted to a frame 48, which is movable with respect to apparatus A, and the probe 46 is movable with respect to the frame 48. These relative movements are initiated by a controller 40 by directing fluid from the flow lines 24 and 26 selectively into the flow lines 42, 44, with the result being that the frame 48 is initially outwardly displaced into contact with the borehole wall (not shown). The extension of the frame 48 helps to steady the tool during use and brings the probe 46 adjacent the borehole wall. Since one objective is to obtain an accurate reading of pressure in the formation, which pressure is reflected at the probe 46, it is desirable to further insert the probe 46 through the built up mudcake and into contact with the formation. Thus, alignment of the hydraulic flow line 24 with the flow line 44 results in relative displacement of the probe 46 into the formation by relative motion of the probe 46 with respect to the frame 48. The operation of the probes 12 and 14 is similar to that of probe 10, and will not be described separately.

Having inflated the packers 28 and 30 and/or set the probe 10 and/or the probes 12 and 14, the fluid withdrawal testing of the formation can begin. The sample flow line 54 extends from the probe 46 in the probe module E down to the outer periphery 32 at a point between the packers 28 and 30 through the adjacent modules and into the sample modules S. The vertical probe 10 and the sink probes 12 and 14 thus allow entry of formation fluids into the sample flow line 54 via one or more of a resistivity measurement cell 56, a pressure measurement device 58, and a pretest mechanism 59, according to the desired configuration. Also, the flowline 64 allows entry of formation fluids into the sample flowline 54. When using the module E, or multiple modules E and F, the isolation valve 62 is mounted downstream of the resistivity sensor 56. In the closed position, the isolation valve 62 limits the internal flow line volume, improving the accuracy of dynamic measurements made by the pressure gauge 58. After initial pressure tests are made, the isolation valve 62 can be opened to allow flow into the other modules via the flowline 54.

When taking initial samples, there is a high prospect that the formation fluid initially obtained is contaminated with mud cake and filtrate. It is desirable to purge such contaminants from the sample flow stream prior to collecting sample(s). Accordingly, the pump-out module M is used to initially purge from the apparatus A specimens of formation fluid taken through the inlet 64 of the straddle packers 28, 30, or vertical probe 10, or sink probes 12 or 14 into the flow line 54.

The fluid analysis module D includes an optical fluid analyzer 99, which is particularly suited for the purpose of indicating where the fluid in flow line 54 is acceptable for collecting a high quality sample. The optical fluid analyzer 99 is equipped to discriminate between various oils, gas, and water. U.S. Pat. Nos. 4,994,671; 5,166,747; 5,939,717; and 5,956,132, as well as other known patents, all assigned to Schlumberger, describe the analyzer 99 in detail, and such description will not be repeated herein, but is incorporated by reference in its entirety.

While flushing out the contaminants from apparatus A, formation fluid can continue to flow through the sample flow line 54 which extends through adjacent modules such as the precision pressure module B, fluid analysis module D, pump out module M, flow control module N, and any number of sample chamber modules S that may be attached as shown in FIG. 3. Those skilled in the art will appreciate that by having a sample flow line 54 running the length of the various modules, multiple sample chamber modules S can be stacked without necessarily increasing the overall diameter of the tool. Alternatively, as explained below, a single sample module S may be equipped with a plurality of small diameter sample chambers, for example by locating such chambers side by side and equidistant from the axis of the sample module. The tool can therefore take more samples before having to be pulled to the surface and can be used in smaller bores.

Referring again to FIGS. 2 and 3, flow control module N includes a flow sensor 66, a flow controller 68, piston 71, reservoirs 72, 73 and 74, and a selectively adjustable restriction device such as a valve 70. A predetermined sample size can be obtained at a specific flow rate by use of the equipment described above.

The sample chamber module S can then be employed to collect a sample of the fluid delivered via flow line 54 and regulated by flow control module N, which is beneficial but not necessary for fluid sampling. With reference fast to upper sample chamber module S in FIG. 3, a valve 80 is opened and valves 62, 62A and 62B are held closed, thus directing the formation fluid in flow line 54 into sample collecting cavity 84C in chamber 84 of sample chamber module S, after which valve 80 is closed to isolate the sample. The chamber 84 has a sample collecting cavity 84C and a pressurization/buffer cavity 84*p*. The tool can then be moved to a different location and the process repeated. Additional samples taken can be stored in any number of additional sample chamber modules S which may be attached by suitable alignment of valves. For example, there are two sample chambers S illustrated in FIG. 3. After having filled the upper chamber by operation of shut-off valve 80, the next sample can be stored in the lowermost sample chamber module S by opening shut-off valve 88 connected to sample collection cavity 90C of chamber 90. The chamber 90 has a sample collecting cavity 90C and a pressurization/buffer cavity 90*p*. It should be noted that each sample chamber module has its own control assembly, shown in FIG. 3 as 100 and 94. Any number of sample chamber modules S, or no sample chamber modules, can be used in particular configurations of the tool depending upon the nature of the test to be conducted. Also, sample module S may be a multi-sample module that houses a plurality of sample chambers, as mentioned above.

It should also be noted that buffer fluid in the form of full-pressure wellbore fluid may be applied to the backsides of the pistons in chambers 84 and 90 to further control the pressure of the formation fluid being delivered to the sample modules S. For this purpose, the valves 81 and 83 are opened, and the piston pump 92 of the pump-out module M must pump the fluid in the flow line 54 to a pressure exceeding wellbore pressure. It has been discovered that this action has the effect of dampening or reducing the pressure pulse or "shock" experienced during drawdown. This low shock sampling method has been used to particular advantage in obtaining fluid samples from unconsolidated formations, plus it allows overpressuring of the sample fluid via piston pump 92.

It is known that various configurations of the apparatus A can be employed depending upon the objective to be accomplished. For basic sampling, the hydraulic power module C can be used in combination with the electric power module L, probe module E and multiple sample chamber modules S. For reservoir pressure determination, the hydraulic power module C can be used with the electric power module L, probe module E and precision pressure module B. For uncontaminated sampling at reservoir conditions, the hydraulic power module C can be used with the electric power module L, probe module E in conjunction with fluid analysis module D, pump-out module M and multiple sample chamber modules S. A simulated Drill Stem Test (DST) test can be run by combining the electric power module L with the packer module P, and the precision pressure module B and the sample chamber modules S. Other configurations are also possible and the makeup of such configurations also depends upon the objectives to be accomplished with the tool. The tool can be of unitary construction a well as modular, however, the modular construction allows greater flexibility and lower cost to users not requiring all attributes.

As mentioned above, the sample flow line 54 also extends through a precision pressure module B. The precision gauge 98 of module B may be mounted as close to probes 12, 14 or 46, and/or to inlet flowline 32, as possible to reduce internal flow line length which, due to fluid compressibility, may affect pressure measurement responsiveness. The precision gauge 98 is typically more sensitive than the strain gauge 58 for more accurate pressure measurements with respect to time. The gauge 98 is preferably a quartz pressure gauge that performs the pressure measurement through the temperature and pressure dependent frequency characteristics of a quartz crystal, which is known to be more accurate than the comparatively simple strain measurement that a strain gauge employs. Suitable valving of the control mechanisms can also be employed to stagger the operation of the gauge 98 and the gauge 58 to take advantage of their difference in sensitivities and abilities to tolerate pressure differentials.

The individual modules of the apparatus A are constructed so that they quickly connect to each other. Preferably, flush connections between the modules are used in lieu of male/female connections to avoid points where contaminants, common in a wellsite environment, may be trapped.

Flow control during sample collection allows different flow rates to be used. Flow control is useful in getting meaningful formation fluid samples as quickly as possible which minimizes the chance of binding the wireline and/or the tool because of mud oozing into the formation in high permeability situations. In low permeability situations, flow control is very helpful to prevent drawing formation fluid sample pressure below its bubble point or asphaltene precipitation point.

More particularly, the "low shock sampling" method described above is useful for reducing to a minimum the pressure drop in the formation fluid during drawdown so as to minimize the "shock" on the formation. By sampling at the smallest achievable pressure drop, the likelihood of keeping the formation fluid pressure above asphaltene precipitation point pressure as well as above bubble point pressure is also increased. In one method of achieving the objective of a minimum pressure drop, the sample chamber is maintained at wellbore hydrostatic pressure as described above, and the rate of drawing connate fluid into the tool is controlled by monitoring the tool's inlet flow line pressure via gauge 58 and adjusting the formation fluid flowrate via pump 92 and/or flow control module N to induce only the minimum drop in the monitored pressure that produces fluid flow from the formation. In this manner, the pressure drop is minimized through regulation of the formation fluid flowrate.

Turning now to FIGS. 4A–D, a sample module SM according to one illustrative embodiment of the present invention is illustrated schematically. The sample module includes a sample chamber 110 for receiving and storing pressurized formation fluid. The piston 112 is slidably disposed in the chamber 110 to define a sample collection cavity 110*c* and a pressurization/buffer cavity 110*p*, the cavities having variable volumes determined by movement of the piston 112 within the chamber 110. A first flowline 54 is provided for communicating fluid obtained from a subsurface formation (as described above in association with FIGS. 2 and 3) through a sample module SM. A second flowline 114 connects the first flowline 54 to the sample cavity 110*c*, and a third flowline 116 connects the sample cavity 110*c* to either the first flowline 54 or an outlet port (not shown) in the sample module SM.

A first seal valve 118 is disposed in the second flowline 114 for controlling the flow of fluid from the first flowline 54 to the sample cavity 110*c*. A second seal valve 120 is disposed in the third flowline 116 for controlling the flow of fluid out of the sample cavity 110*c*. Given this setup, any fluid preloaded in the "dead volume" defined by the sample cavity 110*c* and the portions of the flowlines 114 and 116 that are sealed off by the seal valves 118 and 120, respectively, may be flushed therefrom using the formation fluid in the first flowline 54 and the seal valves 118 and 120.

Figure 4D:
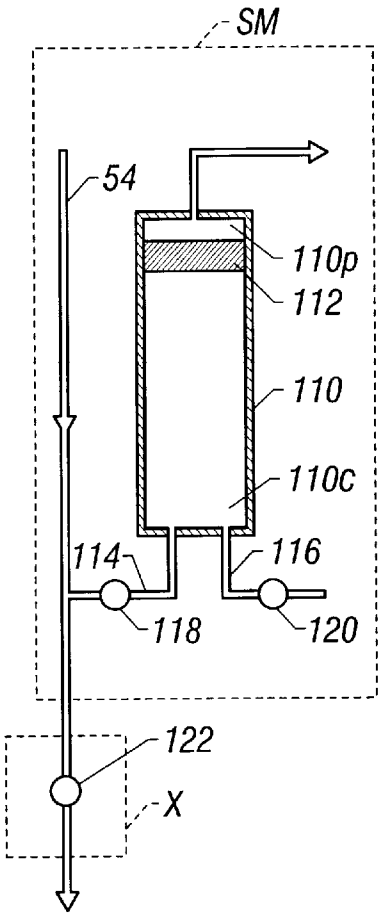
Figure 4C:
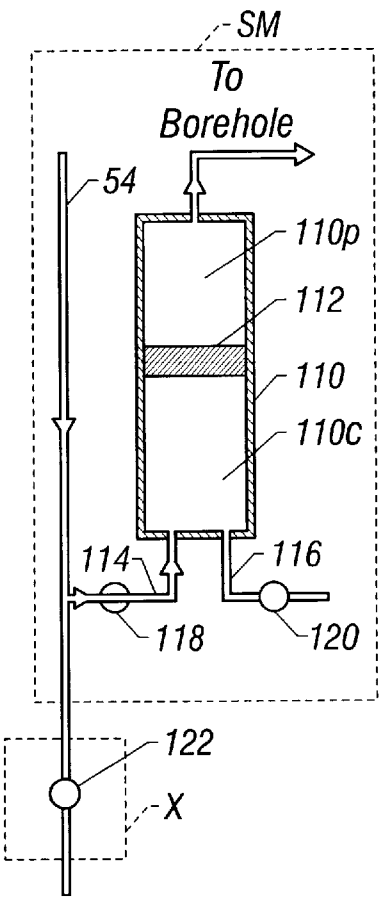
Figure 4B:
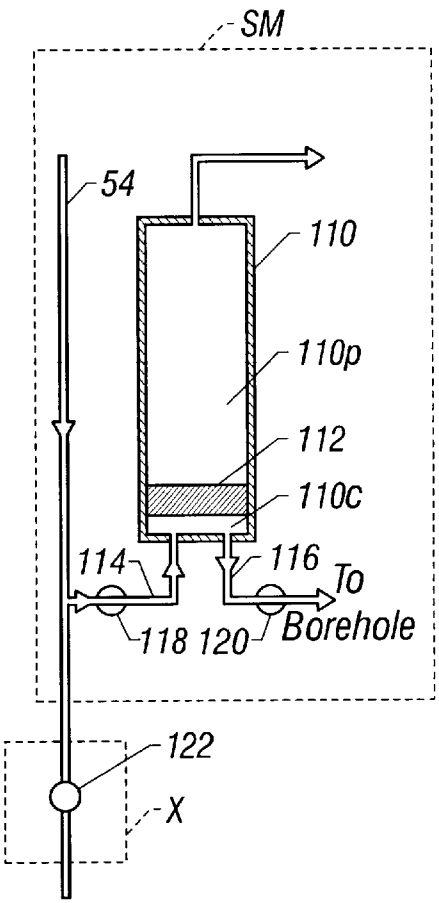
Figure 4A:
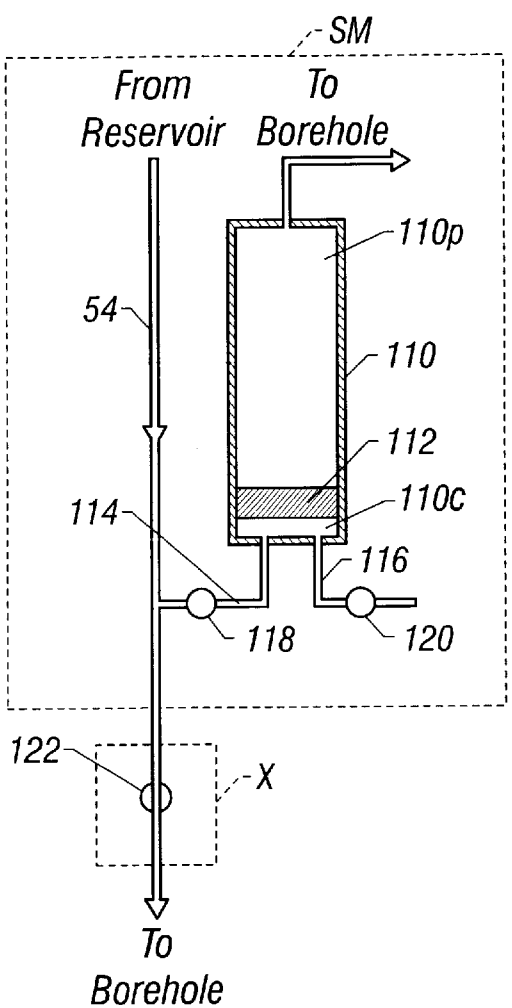

FIG. 4A shows that the valves 118 and 120 are both initially closed so that formation fluid being communicated via the above-described modules through the first flowline 54 of the tool A, including the portion of the first flowline 54 passing through the sample module SM, bypasses the sample chamber 110. This bypass operation permits contaminants in the newly-introduced formation fluid to be flushed through the tool A until the amount of contamination in the fluid has been reduced to an acceptable level. Such an operation is described above in association with the optical fluid analyzer 99.

Typically, a fluid such as water will fill the dead volume space between the seal valves 118 and 120 to minimize the pressure drop that the formation fluid experiences when the seal valves 118, 120 are opened. When it is desired to capture a sample of the formation fluid in the sample cavity 110*c* of the sample chamber 110, and the analyzer 99 indicates the fluid is substantially free of contaminants, the first step will be to flush the water (although other fluids may be used, water will be described hereinafter) out of the dead volume space. This is accomplished, as seen in FIG. 4B, by opening both seal valves 118 and 120 and blocking the first flowline 54 by closing the valve 122 within another module X of tool A. This action diverts the formation fluid "in" through first seal valve 118, through the sample cavity 110*c*, and "out" through the second seal valve 120 for delivery to the borehole. In this manner, any extraneous water disposed in the dead volume between the seal valves 118 and 120 will be flushed out with contaminant-free formation fluid.

After a short period of flushing, the second seal valve 120 is closed, as shown in FIG. 4C, causing formation fluid to fill the sample cavity 110*c*. As the sample cavity is filled, the buffer fluid present in the buffer/pressurization cavity 110*p* is displaced to the borehole by movement of the piston 112.

Once sample cavity 110*c* is adequately filled, the first seal valve 118 is closed to capture the formation fluid sample in the sample cavity. Because the buffer fluid in cavity 110*p* is in contact with the borehole in this embodiment of the present invention, the formation fluid must be raised to a pressure above hydrostatic pressure in order to move the piston 112 and fill the sample cavity 110*c*. This is the low shock sampling method described above. After piston 112 reaches it's maximum travel, the pump module M raises the pressure of the fluid in the sample cavity 110*c* to some desirable level above hydrostatic pressure prior to shutting the first seal valve 118, thereby capturing a sample of formation fluid at a pressure above hydrostatic pressure. This "captured" position is illustrated in FIG. 4D.

The various modules of tool A have the capability of being placed above or below the module (for example, module E, F, and/or P of FIG. 2) which engages the formation. This engagement occurs at a point known as the sampling point. FIGS. 5A–B depict structure for positioning the flowline shut-off valve 122 in the sample module SM itself while maintaining the ability to place the sample module above or below the sampling point. The shut-off valve 122 is used to divert the flow into the sample cavity 110*c* from a sampling point below the sample chamber 110 in FIG. 5A, and from a sampling point above the sample chamber 110 in FIG. 5B. Both figures show formation fluid being diverted from the first flowline 54 into the second flowline 114 via first seal valve 118. The fluid passes through sample cavity 110*c* and back to the first flowline 54 via the third flowline 116 and second seal valve 120. From there, the formation fluid in the flowline 54 may be delivered to other modules of the tool A or dumped to the borehole.

The embodiments of FIGS. 4A–D and 5A–B place the buffer fluid in the buffer cavity 110*p* in direct contact with the borehole fluid. Again, this results in the low shock method for sampling described above. Sample chamber 110 can also be configured such that no buffer fluid is present behind the piston, and only air fills the buffer cavity 110*p*. This would result in a standard air cushion sampling method. However, in order to use some of the other capabilities (described below) of the various modules of tool A, the buffer fluid in the buffer cavity 110*p* must be routed back to the flowline 54. Thus, air may not be desirable in these instances.

The present invention may be further equipped in certain embodiments, as shown in FIGS. 6A–D, with a fourth flowline 124 connected to the buffer cavity 110*p* of the sample chamber 110 for communicating buffer fluid into and out of the buffer cavity 110*p*. The fourth flowline 124 is also connected to the first flowline 54 downstream of the shut off valve 122, whereby the collection of a fluid sample in the sample cavity 110*c* will expel buffer fluid from the buffer cavity 110*p* into the first flowline 54 via the fourth flowline 124.

A fifth flowline 126 is connected to the fourth flowline 124 and to the first flowline 54, the latter connection being upstream of the connection between the first flowline 54 and the second flowline 114. The fourth flowline 124 and the fifth flowline 126 permit manipulation of the buffer fluid to create a pressure differential across the piston 112 for selectively drawing a fluid sample into the sample cavity 110*c*. This process will be explained further below with reference to FIGS. 7A–D.

Figures 6A, 6B, 6C, 6D:
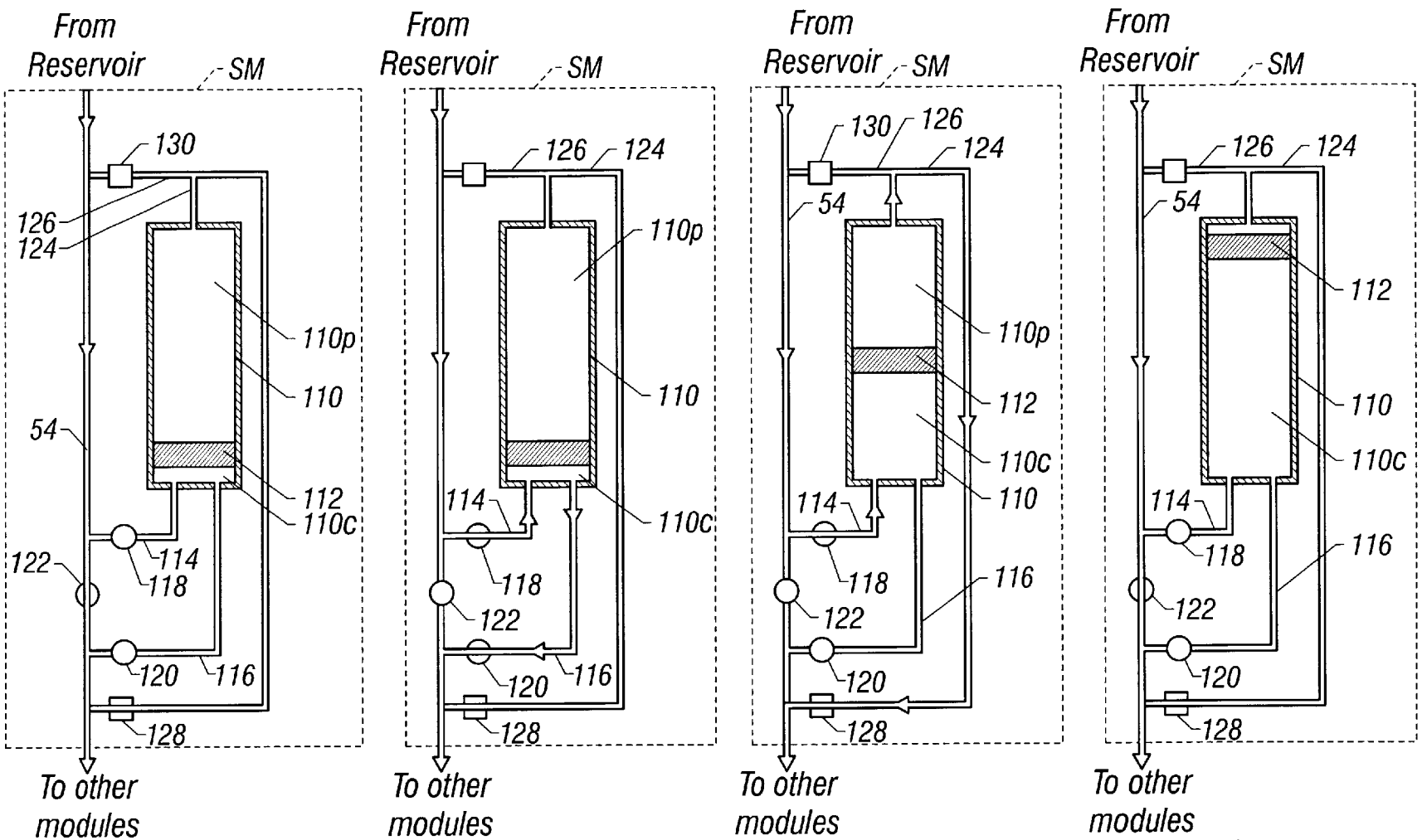

The buffer fluid is routed to the first flowline 54 both above the flowline seal valve 122 and below the flowline seal valve 122 via the flowlines 124 and 126. Depending on whether the formation fluid is flowing from top to bottom (as shown in FIGS. 6A–D) or bottom to top, one of the manual valves 128, 130 in the buffer fluid flowlines 124, 126, respectively, is opened and the other one shut. In FIGS. 6A–D, the flow is coming from the top of the sample module SM and flowing out the bottom of the sample module, so the top manual valve 130 is closed and the bottom manual valve 128 is opened. The sample module is initially configured with the first and second seal valves 118 and 120 closed and the flowline seal valve 122 open, as shown in FIG. 6A.

When a sample of formation fluid is desired, the first step again is to flush out the dead volume fluid between the fist and second seal valves 118 and 120. This step is shown in FIG. 6B, wherein the seal valves 118 and 120 are opened and the flowline seal valve 122 is closed. These valve settings divert the formation fluid through the sample cavity 110*c* and flush out the dead volume.

After a short period of flushing, the second seal valve 120 is closed as seen in FIG. 6C. The formation fluid then fills the sample cavity 110*c* and the buffer fluid in the buffer cavity 110*p* is displaced by the piston 112 into the flowline 54 via the fourth flowline 124 and the open manual valve 128. Because the buffer fluid is now flowing through the first flowline 54, it can communicate with other modules of the tool A. The flow control module N can be used to control the flow rate of the buffer fluid as it exits the sample chamber 110. Alternatively, by placing the pump module M below the sample module SM, it can be used to draw the buffer fluid out of the sample chamber, thereby reducing the pressure in the sample cavity 110*c* and drawing formation fluid into the sample cavity (described further below). Still further, a standard sample chamber with an air cushion can be used as the exit port for the buffer fluid in the event that the pump module fails. Also, the flowline 54 can communicate with the borehole, thereby reestablishing the above-described low shock sampling method.

Once the sample chamber 110*c* is filled and the piston 112 reaches its upper limiting position, as shown in FIG. 6D, the collected sample may be overpressured (as described above) before closing the first and second seal valves 118 and 120 and reopening the flowline seal valve 122.

The low shock sampling method has been established as a way to minimize the amount of pressure drop on the formation fluid when a sample of this fluid is collected. As stated above, the way this is normally done is to configure the sample chamber 110 so that borehole fluid at hydrostatic pressure is in direct communication with the piston 112 via the buffer cavity 110*p*. A pump of some sort, such as the piston pump 92 of pump module M, is used to reduce the pressure of the port which communicates with the reservoir, thereby inducing flow of the formation or formation fluid into the tool A. Pump module M is placed between the reservoir sampling point and the sample module SM. When it is desired to take a sample, the formation fluid is diverted into the sample chamber. Since the piston 112 of the sample chamber is being acted upon by hydrostatic pressure, the pump must increase the pressure of the formation fluid to at least hydrostatic pressure in order to fill the sample cavity 110*c*. After the sample cavity is full, the pump can be used to increase the pressure of the formation fluid even higher than hydrostatic pressure in order to mitigate the effects of pressure loss through cooling of the formation fluid when it is brought to surface.

Thus, in low shock sampling, the pump module M must lower the pressure at the reservoir interface and then raise the pressure at the pump discharge or outlet to at least hydrostatic pressure. The formation fluid, however, must pass through the pump module to accomplish this. This is a concern, because the pump module may have extra pressure drops associated with it that are not witnessed at the well-bore wall due to check valves, relief valves, porting, and the like. These extraneous pressure drops could have an adverse affect on the integrity of the sample, especially if the drawdown pressure is near the bubble point or asphaltene drop-out point of the formation fluid.

Figure 7D:
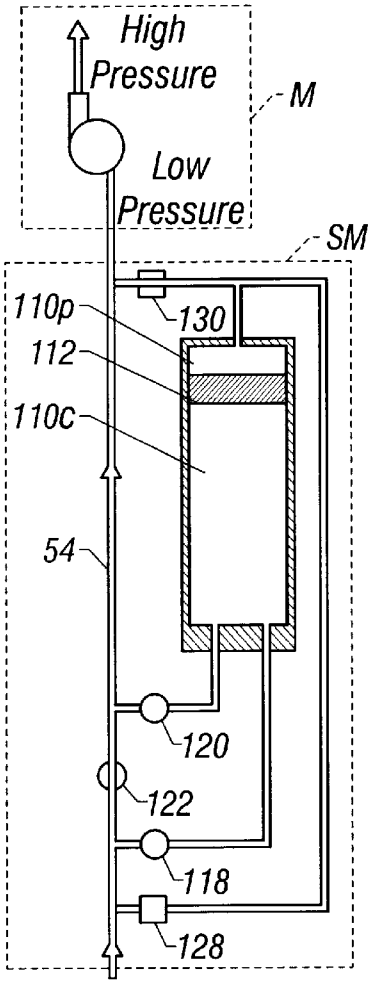
Figure 7C:
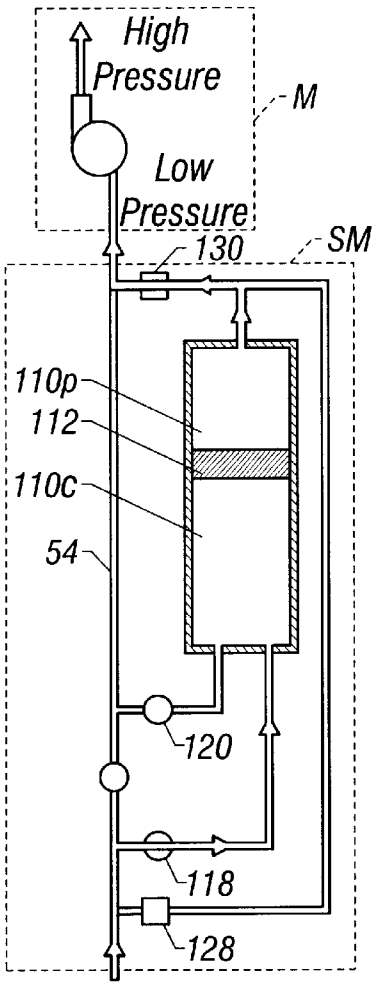
Figure 7B:
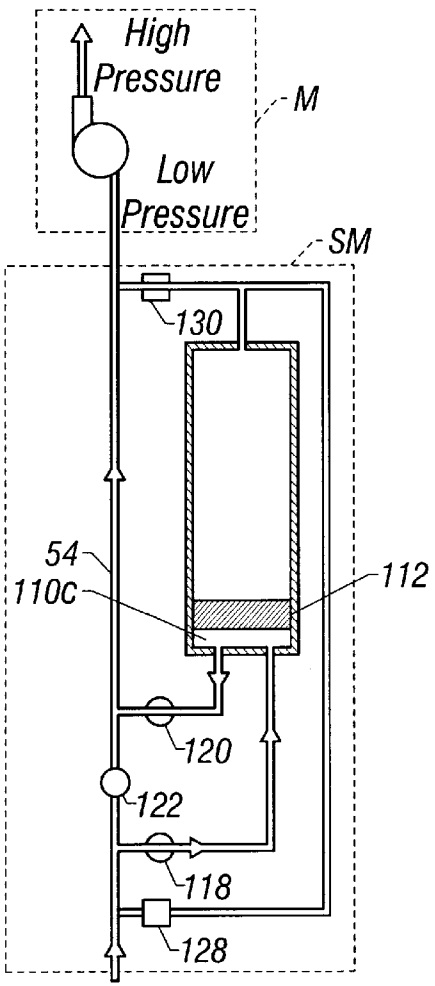
Figure 7A:
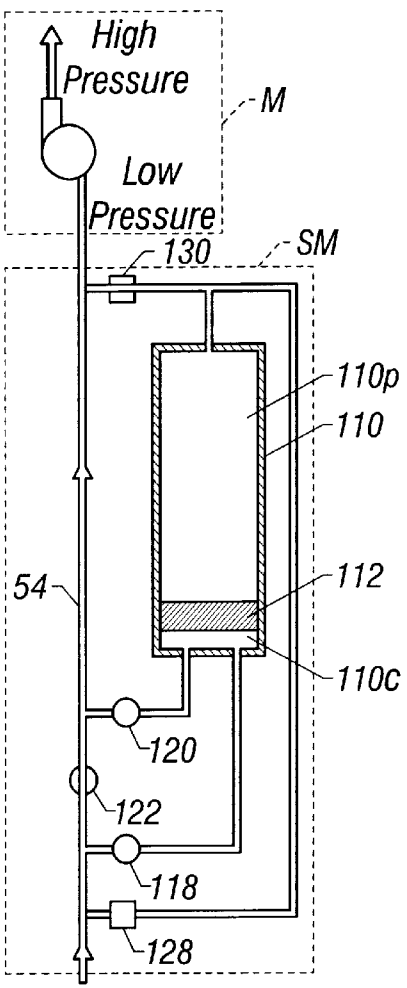

Because of these concerns, a new methodology for sampling that incorporates the advantages of the present invention is now proposed. This involves using the pump module M to reduce the pressure at the reservoir interface as described above. However, the sample module SM is placed between the sampling point and the pump module. FIGS. 7A–D depict this configuration. Pump module M is used to pump formation fluid through the tool A via the first flowline 54 and the open third seal valve 122, as shown in FIG. 7A, until it is determined that a sample is desired. Both the first seal valve 118 and the second seal valve 120 of the sample module SM are then opened and the third flowline seal valve 122 is closed, as illustrated by FIG. 7B. This causes the formation fluid in the flowline 54 to be diverted through the sample cavity 110*c* and flush out the dead volume liquid between the valves 118 and 120. After a short period of flushing, the second seal valve 120 is closed. Pump module M then has communication only with the buffer fluid in the buffer cavity 110*p* The buffer fluid pressure is reduced via the pump module, whose outlet goes to the borehole at hydrostatic pressure. Since the buffer fluid pressure is reduced below reservoir pressure, the pressure in the sample cavity 110*c* behind the piston 112 is reduced, thereby drawing formation fluid into the sample cavity as shown in FIG. 7C. When the sample cavity 110*c* is full, the sample can be captured by closing the first seal valve 118 (seal valve 120 already being closed). The benefits of this method are that the formation fluid is not subjected to any extraneous pressure drops due to the pump module. Also, the pressure gauge which is located near the sampling point in the probe or packer module will indicate the actual pressure (plus/minus the hydrostatic head difference) at which the reservoir pressure enters the sample cavity 110*c*.

FIGS. 8A–D illustrate similar structure and methodology to that shown in FIGS. 7A–D, except the former figures illustrate a means to pressurize buffer fluid cavity 110*p* with a pressurized gas to maintain the formation fluid in sample cavity 110*c* above reservoir pressure. This eliminates the need/desire to overpressure the collected sample with the pump module, as described above. Two particular additions in this embodiment are an extra seal valve 132 in fourth flowline 124 controlling the exit of the buffer fluid from buffer cavity 110*p,* and a gas charging module GM which includes a fifth seal valve 134 to control when pressurized fluid in cavity 140*c* of gas chamber 140 is communicated to the buffer fluid. The chamber 140 has a sample collecting cavity 140C and a pressurization/buffer cavity 140*p*.

Seal valve 132 on the buffer fluid can be used to ensure that the piston 112 in the sample chamber 110 does not move during the flushing of the sample cavity. In the embodiment of FIGS. 7A–D, there is no means to positively keep the piston 112 from moving. During dead volume flushing, the pressure in the sample cavity 110*c* is equal to the pressure in the buffer cavity 110*p* and therefore the piston 112 should not move due to the friction of the piston seals (not shown). To ensure that the piston does not move, it is desirable to have a positive method of locking in the buffer fluid such as the seal valve 132. Other alternatives are available, such as using a relief device with a low cracking pressure that would ensure that more pressure is needed to dispel the buffer fluid than to flush the dead volume. The seal valve 132 is also beneficial for capturing the buffer fluid after it has been charged by the nitrogen pressurized charge fluid in the cavity 140*c*.

Figures 8A, 8B, 8C, 8D:
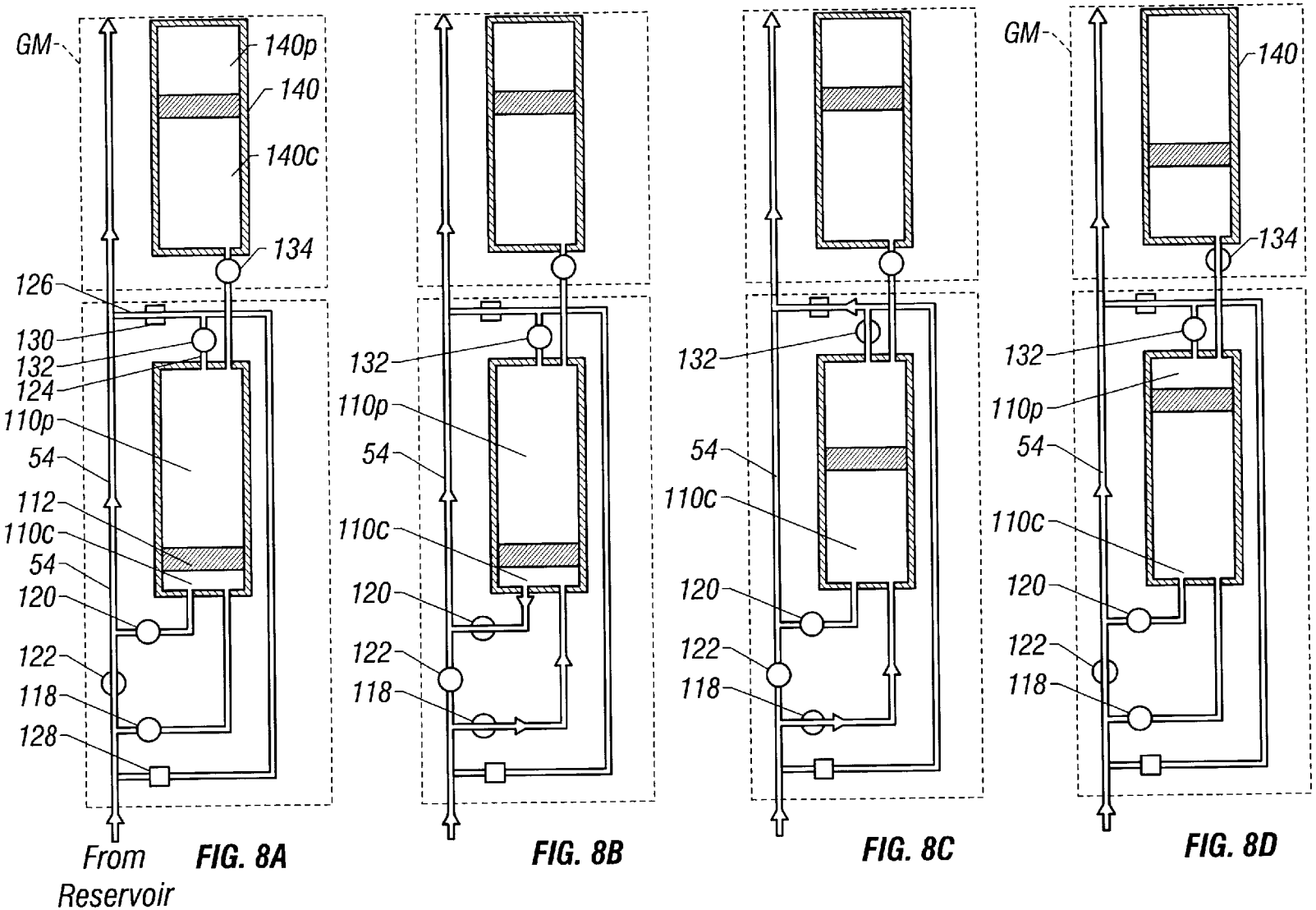

The method of sampling with the embodiment of FIGS. 8A–D is very similar to that described above for the other embodiments. While the formation fluid is being pumped through the flowline 54 across the various modules to minimize the contamination in the fluid, as seen in FIG. 8A, the third seal valve 122 is open while the first and second seal valves 118 and 120, along with the buffer seal valve 132 and charge module seal valve 134, are all closed. When a sample is desired, the first and second seal valves 118 and 120 are opened, the third, flowline seal valve 122 is closed, and the buffer fluid seal valve 132 remains closed. The formation fluid is thereby pumped through the sample cavity 110*c* to flush any water out of the dead volume space between the valves 118 and 120, which is shown in FIG. 8B. After a short period of flushing, the buffer seal valve 132 is opened, the second seal valve 120 is closed (first seal valve 118 remaining open), and the formation fluid begins to fill the sample cavity 110*c,* as seen in FIG. 8C.

Once the sample cavity 110*c* is full, the first seal valve 118 is closed, the buffer seal valve 132 is closed, and the third flowline seal valve 122 is opened so that pumping and flow through the flowline 54 can continue. To pressurize the formation fluid with gas charge module GM, the fifth seal valve 134 is opened thereby communicating the charge fluid to the buffer cavity 110*p*. Valve 134 remains open as the tool is brought to the surface, thereby maintaining the formation fluid at a higher pressure in the sample cavity 110*c* even as the sample chamber 110 cools. An alternative tool and method to using a fifth seal valve 134 to actuate the charge fluid in the gas module GM has been developed by Oilphase, a division of Schlumberger, and is described in U.S. Pat. No. 5,337,822, which is incorporated herein by reference. In this tool and method, through valving within the sample chamber of bottle 110 itself closes off the buffer and sampling ports and then opens a port to the charge fluid, thereby pressurizing the sample.

Even if there is no gas charge module present in the embodiment illustrated in FIGS. 8A–D, the alternative low shock sampling method described above and depicted in FIGS. 7A–D can still be used. Also, because there is a seal valve 132, which captures the buffer fluid after the formation fluid has been captured in the sample cavity 110*c,* the pump module M can be reversed to pump in the other direction. In other words, the pump module can be utilized to pressurize the buffer fluid in the buffer cavity 110*p,* which acts on the piston 112, and thereby pressurize the formation fluid captured in the sample cavity 110*c*. In essence, this process will duplicate the standard low shock method described above. The fourth seal valve 132 on the buffer fluid can then be closed to capture the appropriately pressurized sample.

Figures 9A, 9B, 9C, 9D:
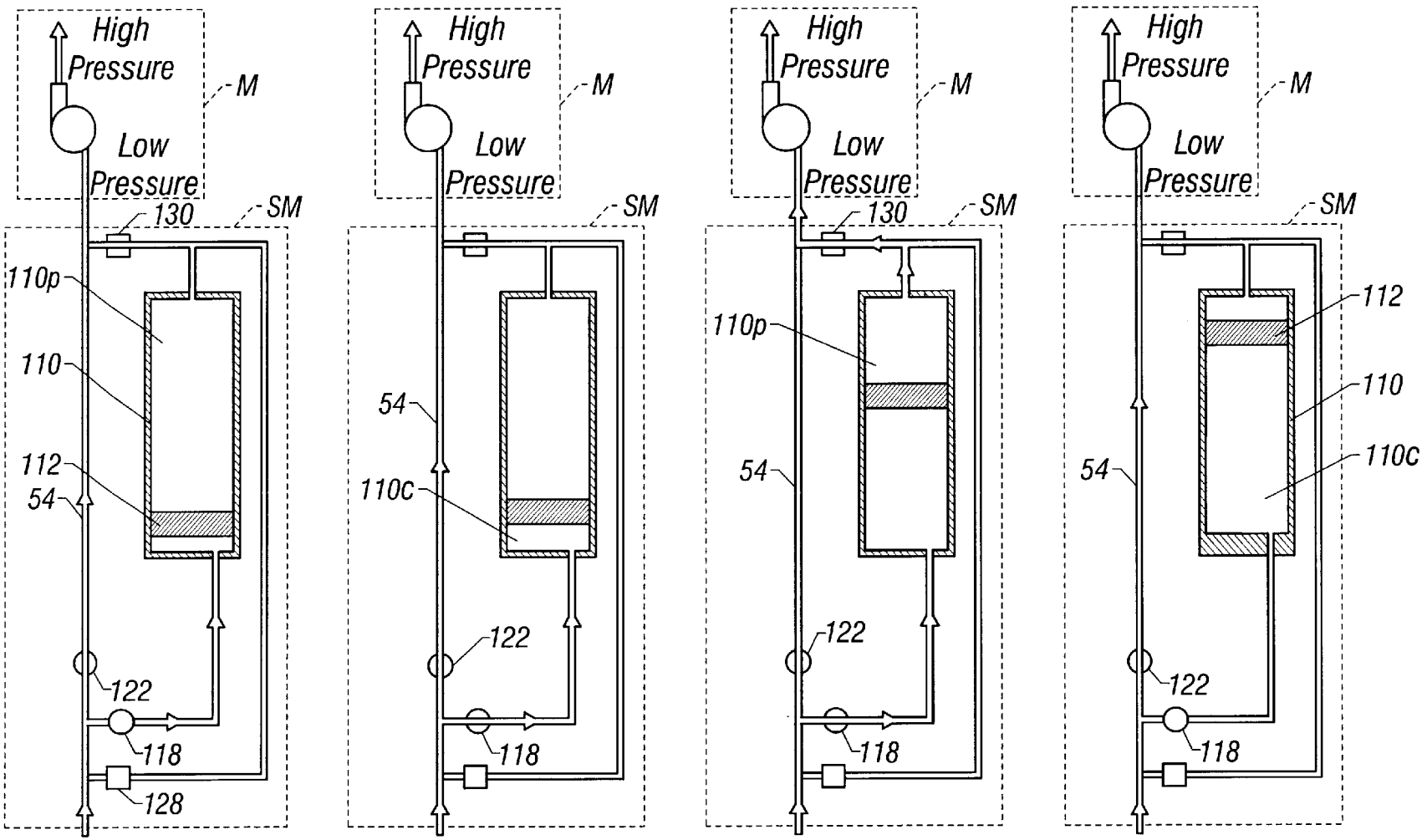

FIGS. 9A–D illustrate an alternative embodiment of the present invention having the sample module SM located between the sampling point and the pump module M. Pump module M is used to pump formation fluid through tool A via the flowline 54 and the open seal valve 122, as shown in FIG. 9A, until it is determined that a sample is desired. In the buffer fluid flowline 126, the manual valve 130 is open and the manual valve 128 is closed.

When a sample is desired, the seal valve 118 of the sample module SM is opened as illustrated by FIG. 9B. This causes a portion of the formation fluid in flowline 54 to be diverted through the seal valve 118 and into the sample cavity 110*c*. There is typically a check valve mechanism (not shown) located on the outlet of the buffer cavity 110*p* in the various embodiments of the present invention. To provide direct communication between the flowline 54 and the fluid in the buffer cavity 110*p,* the check mechanism should be removed. With the check mechanism removed, the pressure in the flowline 54 will be approximately equal with the pressure within the buffer cavity 110*p* of the sample chamber 110.

The terms "equalize", "equivalent pressure", "approximately equivalent pressure" and other like terms within the present application are used to describe relative pressures between two locations within a flowline or an apparatus. It is well known that fluid flows will be subject to frictional pressure losses while flowing unrestricted through a flowline, these ordinary and slight pressure differences are not considered significant within the scope of this application. Therefore within this application, two locations in a system that are in fluid communication with each other and are capable of unrestricted fluid movement between the two locations will be considered to be of equivalent pressure to each other. In some embodiments of the present invention an equivalent pressure between the sample cavity 110*c* and the buffer cavity 110*p* is one that has a differential pressure of less than 50 psi. In other embodiments of the present invention an equivalent pressure between the sample cavity 110*c* and the buffer cavity 110*p* is one that has a differential pressure of less than 25 psi. In yet another embodiment of the present invention an equivalent pressure between the sample cavity 110*c* and the buffer cavity 110*p* is one that has a differential pressure of less than 10 psi. In still other embodiments of the present invention an equivalent pressure between the sample cavity 110*c* and the buffer cavity 110*p* is one that has a differential pressure of less than 5 psi. In yet other embodiments of the present invention an equivalent pressure between the sample cavity 110*c* and the buffer cavity 110*p* is one that has a differential pressure of less than 2 psi.

The pump module M then has communication with the buffer fluid in the buffer cavity 110*p* in addition to the fluid within the flowline 54. Since the manual valve 130 is open, the buffer fluid within the buffer cavity 110*p* will have the approximately equivalent pressure as the fluid within the flowline 54. The buffer fluid can then be removed from buffer cavity 110*p* via the pump module M, whose outlet returns to the borehole at the hydrostatic pressure of the well. As fluid is removed from the buffer cavity 110*p*, the piston 112 will move, thereby drawing formation fluid into the sample cavity 110*c* as shown in FIG. 9C.

Since the seal valve 118 and the manual valve 130 remain in an open position, the pressure within the sample chamber 110 remains approximately equal to the flowline 54 pressure during the pumpout and the sampling operations. There can be a differential pressure across the open seal valve 122 resulting from the flow of fluids in the flowline 54 passing through the restriction of the open or partially open seal valve 112. This differential pressure can provide a driving force for fluid to enter the sample cavity 110*c*, while the sample cavity 110*c* and the buffer cavity 110*p* remain at approximately equivalent pressures. This provides a low shock sampling method that has the added benefit that the sample fluid does not need to pass through the pump module M prior to isolation within the sample chamber 110.

When the sample cavity 110*c* is full, the closing of seal valve 118, as shown in FIG. 9D, can capture the sample fluid. Once the seal valve 118 has been closed, the flow of fluids through the flowline 54 and through the pump module M can either be stopped, or can be continued if additional sample or testing modules require the flow of reservoir fluids.

FIGS. 10A–D depicts an alternate embodiment of the present invention having the sample module SM located between the sampling point and the pump module M. This embodiment is similar to the embodiment shown in FIGS. 9A–D, but has the added feature of an additional flowline and valve 120 providing fluid communication between the sample cavity 110*c* and the flowline 54, connecting to flowline 54 at a location downstream of the valve 122.

Figure 10D:
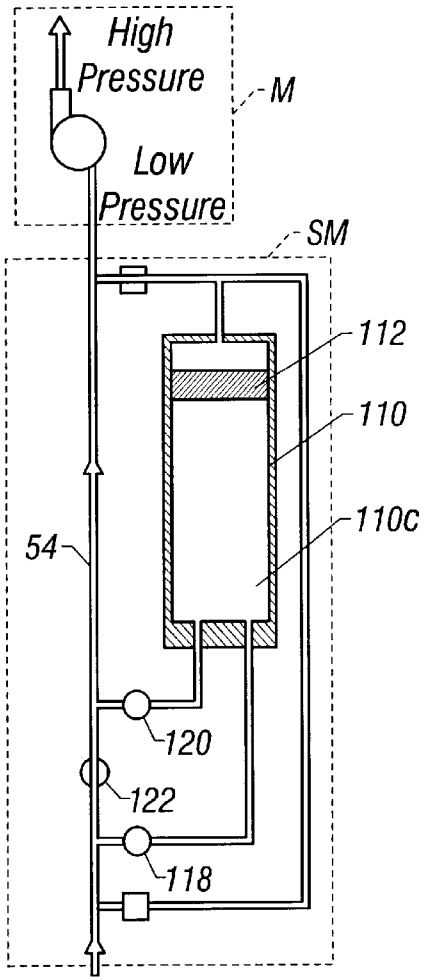
Figure 10C:
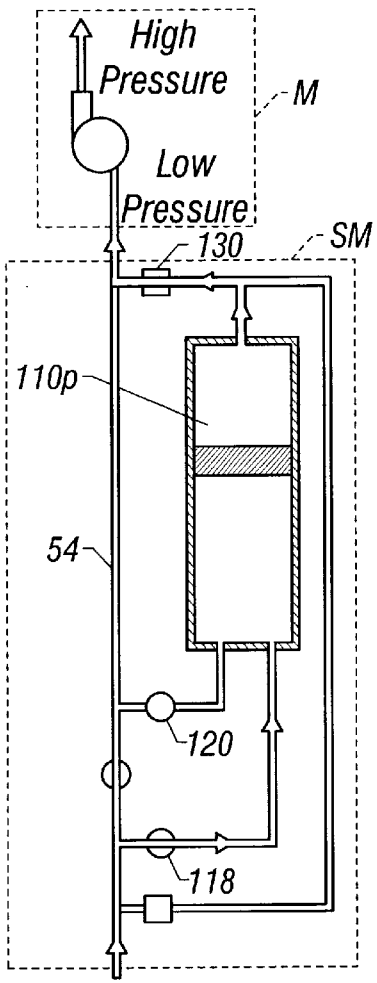
Figure 10B:
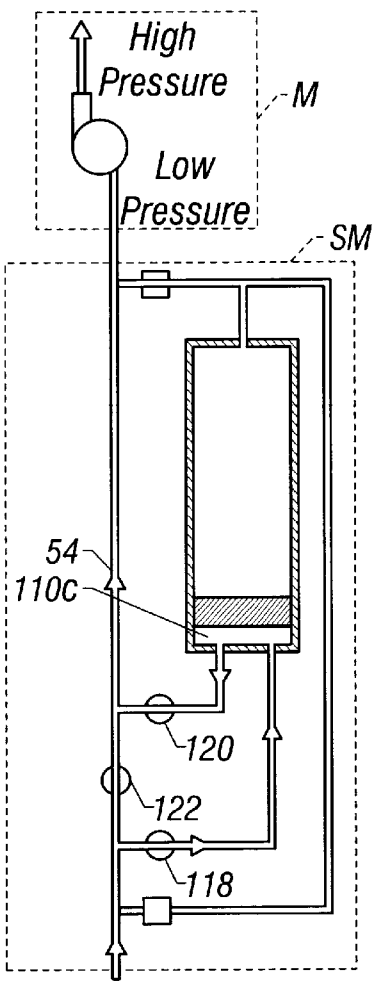
Figure 10A:
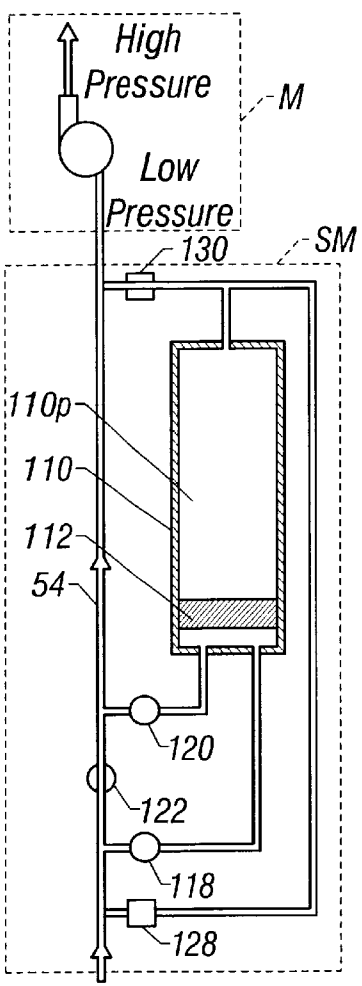

Pump module M is used to pump formation fluid through the tool A via the flowline 54 and the open seal valve 122 as shown in FIG. 10A, until it is determined that a sample is desired. In the buffer fluid flowline 126, the manual valve 130 is open and the manual valve 128 is closed. Both seal valve 118 and seal valve 120 of the sample module SM are then opened while the seal valve 122 remains in its open position, as illustrated by FIG. 10B. This causes a portion of the formation fluid in the flowline 54 to be diverted through the sample cavity 110*c* and flush out the dead volume liquid between the valves 118 and 120. After a short period of flushing, the seal valve 120 is closed. Pump module M then has communication with fluid in the flowline 54 and with the buffer fluid in the buffer cavity 110*p*. The buffer fluid is then removed from the buffer cavity 110*p* via the pump module, whose outlet returns to the borehole at hydrostatic pressure. The removal of the buffer fluid from the buffer cavity 110*p* causes the piston 112 to move toward the buffer end of the sample chamber 110, thereby drawing formation fluid into the sample cavity as shown in FIG. 10C. When the sample cavity 110*c* is full, the sample can be captured by closing the seal valve 118 (seal valve 120 already being closed), as shown in FIG. 10D. The fluid sample, being in fluid communication with the flowline 54, will have the same pressure during pumpout and sampling, thereby providing low shock sampling. Some of the benefits of this method are that the formation fluid is not subjected to any extraneous pressure drops due to flow through the pump module, or any possible contamination due to impurities within the pump module. Also, the pressure gauge, which is located near the sampling point in the probe or packer module, will indicate the actual pressure (plus/minus the hydrostatic head difference) at which the reservoir pressure enters the sample cavity 110*c*.

As will be readily apparent to those skilled in the art, the present invention may easily be produced in other specific forms without departing from its spirit or essential characteristics. The present embodiment is, therefore, to be considered as merely illustrative and not restrictive. The scope of the invention is indicated by the claims that follow rather than the foregoing description, and all changes which come within the meaning and range of equivalence of the claims are therefore intended to be embraced therein.

What is claimed is:

1. A sample module for use in a tool adapted for insertion into a subsurface wellbore for obtaining fluid samples, said sample module comprising:

a sample chamber for receiving and storing pressurized fluid;

a piston slidably disposed in said chamber to define a sample cavity and a buffer cavity, the cavities having variable volumes determined by movement of said piston;

a first flowline for communicating fluid obtained from a subsurface formation through the sample module;

a second flowline connecting the first flowline to the sample cavity;

a third flowline connecting the first flowline to the buffer cavity of the sample chamber for communicating buffer fluid between the buffer cavity and the first flowline;

a first valve capable of moving between a closed position and an open position disposed in the second flowline for communicating flow of fluid from the first flowline to the sample cavity; and wherein when the first valve is in the open position the sample cavity and the buffer cavity are in fluid communication with the first flowline and therefore have approximately equivalent pressures.

2. The sample module of claim 1, further comprising a second valve disposed in said first flowline between the second flowline and the third flowline.

3. The sample module of claim 2, wherein the second flowline is connected to the first flowline upstream of said second valve.

4. The sample module of claim 3, wherein said third flowline is connected to the first flowline downstream of the second valve.

5. The sample module of claim 1, further comprising a fourth flowline connected to the sample cavity of said sample chamber for communicating fluid out of the sample cavity.

6. The sample module of claim 5, wherein said fourth flowline is also connected to said first flowline, whereby any fluid preloaded in the sample cavity may be flushed therefrom using formation fluid via said fourth flowline.

7. The sample module of claim 6, wherein the fourth flowline is connected to the first flowline downstream of the second valve.

8. The sample module of claim 6, further comprising a third valve disposed in said fourth flowline for controlling the flow of fluid through said fourth flowline.

9. The sample module of claim 1, wherein the sample module is a wireline conveyed formation testing tool.

10. The sample module of claim 1, wherein the sample cavity and the buffer cavity have a pressure differential between them that is less than 50 psi.

11. The sample module of claim 1, wherein the sample cavity and the buffer cavity have a pressure differential between them that is less than 25 psi.

12. The sample module of claim 1, wherein the sample cavity and the buffer cavity have a pressure differential between them that is less than 5 psi.

13. A sample module for obtaining fluid samples from a subsurface wellbore, comprising:

a sample chamber for receiving and storing pressurized fluid;

a piston movably disposed in the chamber defining a sample cavity and a buffer cavity, the cavities having variable volumes determined by movement of the piston;

a first flowline for communicating fluid obtained from a subsurface formation through the sample module;

a second flowline connecting the first flowline to the sample cavity;

a third flowline connecting the first flowline to the buffer cavity of the sample chamber for communicating buffer fluid out of the buffer cavity;

a first valve capable of moving between a closed position and an open position disposed in the second flowline for communicating flow of fluid from the first flowline to the sample cavity;

a second valve capable of moving between a closed position and an open position disposed in the first flowline between the second flowline and the third flowline; and wherein when the first valve and the second valve are in the open position, the sample cavity and the buffer cavity are in fluid communication with the first flowline and therefore have approximately equivalent pressures.

14. The sample module of claim 13, wherein the sample cavity and the buffer cavity have a pressure differential between them that is less than 50 psi.

15. The sample module of claim 13, wherein the sample cavity and the buffer cavity have a pressure differential between them that is less than 25 psi.

16. The sample module of claim 13, wherein the sample cavity and the buffer cavity have a pressure differential between them that is less than 5 psi.

17. An apparatus for obtaining fluid from a subsurface formation penetrated by a wellbore, comprising:

a probe assembly for establishing fluid communication between the apparatus and the formation when the apparatus is positioned in the wellbore;

a pump assembly for drawing fluid from the formation into the apparatus via said probe assembly;

a sample module for collecting a sample of the formation fluid drawn from the formation by said pumping assembly, said sample module comprising:

a chamber for receiving and storing fluid;

a piston slidably disposed in said chamber to define a sample cavity and a buffer cavity, the cavities having variable volumes determined by movement of said piston;

a first flowline in fluid communication with said pump assembly for communicating fluid obtained from the formation through the sample module;

a second flowline connecting said first flowline to the sample cavity; and a first valve disposed in said second flowline for controlling the flow of fluid from said first flowline to the sample cavity;

wherein when the first valve is in the open position the sample cavity and the buffer cavity are in fluid communication with the first flowline and thereby have approximately equivalent pressures.

18. The apparatus of claim 17, further comprising a second valve disposed in said first flowline between the second flowline and the third flowline.

19. The apparatus of claim 18, wherein the second flowline is connected to the first flowline upstream of said second valve.

20. The apparatus of claim 19, wherein said third flowline is connected to the first flowline downstream of the second valve.

21. The apparatus of claim 17, further comprising a fourth flowline connected to the sample cavity of said sample chamber for communicating fluid out of the sample cavity.

22. The apparatus of claim 21, wherein said fourth flowline is also connected to said first flowline, whereby any fluid preloaded in the sample cavity may be flushed therefrom using formation fluid via said fourth flowline.

23. The apparatus of claim 22, wherein the fourth flowline is connected to the first flowline downstream of the second valve.

24. The apparatus of claim 22, further comprising a third valve disposed in said fourth flowline for controlling the flow of fluid through said fourth flowline.

25. The apparatus of claim 17, wherein the apparatus is a wireline-conveyed formation testing tool.

26. The apparatus of claim 17, wherein the sample cavity and the buffer cavity have a pressure differential between them that is less than 50 psi.

27. The apparatus of claim 17, wherein the sample cavity and the buffer cavity have a pressure differential between them that is less than 25 psi.

28. The apparatus of claim 17, wherein the sample cavity and the buffer cavity have a pressure differential between them that is less than 5 psi.

29. A method for obtaining fluid from a subsurface formation penetrated by a wellbore, comprising:

positioning a formation testing apparatus within the wellbore, the testing apparatus comprising a sample chamber having a floating piston slidably positioned therein so as to define a sample cavity and a buffer cavity;

establishing fluid communication between the apparatus and the formation;

inducing movement of fluid from the formation through a first flowline in the apparatus with a pump located down stream of the first flowline;

establishing communication between the sample cavity and the first flowline, whereby the sample cavity and the first flowline have approximately equivalent pressures;

establishing communication between the buffer cavity and the first flowline, whereby the buffer cavity and the first flowline have approximately equivalent pressures;

removing buffer fluid from the buffer cavity, thereby moving the piston within the sample chamber;

delivering a sample of the formation fluid into the sample cavity of the sample chamber; and withdrawing the apparatus from the wellbore to recover the collected sample.

30. The method of claim 29, further comprising:

flushing out at least a portion of a fluid precharging the sample cavity by inducing movement of at least a portion of the formation fluid though flowlines leading into and out of the sample cavity.

31. The method of claim 30, further comprising:

collecting a sample of the formation fluid within the sample cavity after the flushing step.

32. The method of claim 31, wherein fluid flow through the flowlines is controlled with seal valves in the flowlines.

33. The method of claim 30, wherein the flushing step includes flushing the precharging fluid out to the borehole.

34. The method of claim 30, wherein the flushing step includes flushing the precharging fluid into a primary flow line within the apparatus.

35. The method of claim 30, further comprising the step of maintaining the sample collected in the sample cavity in a single phase condition as the apparatus is withdrawn from the wellbore.

36. The method of claim 29, wherein the formation fluid is drawn into the sample cavity by movement of the piston as the buffer fluid is withdrawn from the buffer cavity, wherein the sample cavity and the first flowline have a pressure differential of less than 50 psi.

37. The method of claim 36, wherein the expelled buffer fluid is delivered to a primary flow line within the apparatus.

38. The method of claim 29, wherein the formation fluid is drawn into the sample cavity by movement of the piston as the buffer fluid is withdrawn from the buffer cavity, wherein the sample cavity and the first flowline have a pressure differential of les than 25 psi.

39. The method of claim 29, wherein the formation fluid is drawn into the sample cavity by movement of the piston as the buffer fluid is withdrawn from the buffer cavity, wherein the sample cavity and the first flowline have a pressure differential of les than 5 psi.

40. The method of claim 29, wherein fluid movement from the formation into the apparatus is induced by a probe assembly engaging the wall of the formation and a pump assembly in fluid communication with the probe assembly, both assemblies being within the apparatus.

41. A sample module for use in a tool adapted for insertion into a subsurface wellbore for obtaining fluid samples, said sample module comprising:

a sample chamber for receiving and storing pressurized fluid;

a piston slidably disposed in said chamber to define a sample cavity and a buffer cavity, the cavities having variable volumes determined by movement of said piston;

a first flowline for communicating fluid obtained from a subsurface formation through the sample module;

a second flowline connecting the first flowline to the sample cavity;

a third flowline connecting the first flowline to the buffer cavity of the sample chamber for communicating buffer fluid between the buffer cavity and the first flowline;

a first valve capable of moving between a closed position and an open position disposed in the second flowline for communicating flow of fluid from the first flowline to the sample cavity;

a fourth flowline connected to the sample cavity of said sample chamber for communicating fluid out of the sample cavity; and wherein when the first valve is in the open position the sample cavity and the buffer cavity are in fluid communication with the first flowline and therefore have approximately equivalent pressures.

42. The sample module or claim 41, further comprising a second valve disposed in said first flowline between the second flowline and the third flowline.

43. The sample module of claim 42, wherein the second flowline is connected to the first flowline upstream of said second valve.

44. The sample module of claim 43, wherein said third flowline is connected to the first flowline downstream of the second valve.

45. The sample module of claim 41, wherein said fourth flowline is also connected to said first flowline, whereby any fluid preloaded in the sample cavity may be flushed therefrom using formation fluid via said fourth flowline.

46. The sample module of claim 45, wherein the fourth flowline is connected to the first flowline downstream of the second valve.

47. The sample module of claim 45, further comprising a third valve disposed in said fourth flowline for controlling the flow of fluid through said fourth flowline.

48. A sample module for obtaining fluid samples from a subsurface wellbore, comprising:

a sample chamber for receiving and storing pressurized fluid;

a piston movably disposed in the chamber defining a sample cavity and a buffer cavity, the cavities having variable volumes determined by movement of the piston;

a first flowline for communicating fluid obtained from a subsurface formation through the sample module;

a second flowline connecting the first flowline to the sample cavity;

a third flowline connecting the first flowline to the buffer cavity of the sample chamber for communicating buffer fluid out of the buffer cavity;

a fourth flowline connected to the sample cavity of said sample chamber for communicating fluid out of the sample cavity;

a first valve capable of moving between a closed position and an open position disposed in the second flowline for communicating flow of fluid from the first flowline to the sample cavity;

a second valve capable of moving between a closed position and an open position disposed in the first flowline between the second flowline and the third flowline; and wherein when the first valve and the second valve are in the open position, the sample cavity and the buffer cavity are in fluid communication with the first flowline and therefore have approximately equivalent pressures.

49. An apparatus for obtaining fluid from a subsurface formation penetrated by a wellbore, comprising:

a probe assembly for establishing fluid communication between the apparatus and the formation when the apparatus is positioned in the wellbore;

a pump assembly for drawing fluid from the formation into the apparatus via said probe assembly;

a sample module for collecting a sample of the formation fluid drawn from the formation by said pumping assembly, said sample module comprising:

a chamber for receiving and storing fluid;

a piston slidably disposed in said chamber to define a sample cavity and a buffer cavity, the cavities having variable volumes determined by movement of said piston;

a first flowline in fluid communication with said pump assembly for communicating fluid obtained from the formation through the sample module;

a second flowline connecting said first flowline to the sample cavity;

a flush flowline connected to the sample cavity of said sample chamber for communicating fluid out of the sample cavity; and a first valve disposed in said second flowline for controlling the flow of fluid from said first flowline to the sample cavity;

wherein when the first valve is in the open position the sample cavity and the buffer cavity are in fluid communication with the first flowline and thereby have approximately equivalent pressures.

50. The apparatus of claim 49, further comprising a second valve disposed in said first flowline between, the second flowline and the third flowline.

51. The apparatus of claim 50, wherein the second flowline is connected to the first flowline upstream of said second valve.

52. The apparatus of claim 51, wherein said third flowline is connected to the first flowline downstream of the second valve.

53. The apparatus of claim 49, wherein said flush flowline is also connected to said first flowline, whereby any fluid preloaded in the sample cavity may be flushed therefrom using formation fluid via said flush flowline.

54. The apparatus of claim 53, wherein the flush flowline is connected to the first flowline downstream of the second valve.

55. The apparatus of claim 54, further comprising a third valve disposed in said flush flowline for controlling the flow of fluid through said flush flowline.

56. A method for obtaining fluid from a subsurface formation penetrated by a wellbore, comprising:

positioning a formation testing apparatus within the wellbore, the testing apparatus comprising a sample chamber having a floating piston slidably positioned therein so as to define a sample cavity and a buffer cavity;

establishing fluid communication between the apparatus and the formation;

inducing movement of fluid from the formation through a first flowline in the apparatus with a pump;

establishing communication between the sample cavity and the first flowline, whereby the sample cavity and the first flowline have approximately equivalent pressures;

flushing out at least a portion of a fluid precharging the sample cavity by inducing movement of at least a portion of the formation fluid though flowlines leading into and out of the sample cavity;

establishing communication between the buffer cavity and the first flowline, whereby the buffer cavity and the first flowline have approximately equivalent pressures;

removing buffer fluid from the buffer cavity, thereby moving the piston within the sample chamber;

delivering a sample of the formation fluid into the sample cavity of the sample chamber; and withdrawing the apparatus from the wellbore to recover the collected sample.

57. The method of claim 56, further comprising;

collecting a sample of the formation fluid within the sample cavity after the flushing step.

58. The method of claim 57, wherein the flushing step includes flushing the precharging fluid out to the borehole.

59. The method of claim 57, wherein the flushing step includes flushing the precharging fluid into a primary flow line within the apparatus.

60. A downhole tool for sampling fluid from a subterranean formation, comprising:

a sample tank having a piston slidably movable therein, the piston defining a sample cavity and a buffer cavity within the tank, the sample tank in selective fluid communication with the formation;

a sample flowline for communicating fluid from the formation to the sample cavity; and a flushing flowline for flushing fluid from the sample cavity into the wellbore.

61. The downhole tool or claim 60 further comprising a buffer flowline for communicating fluid from the wellbore to the buffer cavity.

62. A downhole tool for obtaining fluid from a subsurface formation penetrated by a wellbore, comprising:

a sample tank having a piston slidably movable therein, the piston defining a sample cavity and a buffer cavity within the tank, the sample cavity in fluid communication with the formation via a sample flowline, the buffer cavity in fluid communication with the wellbore via a buffer flowline; and a flushing flowline in selective fluid communication with the sample cavity for flushing fluid into the wellbore.

63. A method for obtaining fluid from a subsurface formation penetrated by a wellbore, comprising:

positioning a downhole tool having a sample tank therein in the wellbore, the sample tank having a piston slidably positionable therein, the piston defining a sample cavity and a buffer cavity within the tank;

establishing fluid communication between the sample cavity and the formation;

establishing fluid communication between the buffer cavity and the wellbore;

inducing movement of formation fluid from the formation through a first flowline to the sample cavity;

flushing fluid from the sample cavity through a second flowline into the wellbore; and inducing movement of buffer fluid from the buffer cavity through a third flowline whereby the piston is moved within the sample chamber and a sample of the formation fluid is drawn into the sample cavity of the sample chamber.

64. A downhole tool for obtaining fluid from a subsurface formation penetrated by a wellbore, comprising:

a sample tank having a piston slidably movable therein, the piston defining a sample cavity and a buffer cavity within the tank, the sample cavity in fluid communication with the formation via a sample flowline, the buffer cavity in fluid communication with the formation via a buffer flowline, the sample and buffer flowlines in fluid communication with each other whereby the pressure in the cavities is equalized; and a flushing flowline in selective fluid communication with the sample cavity for flushing fluid therefrom.

65. A method of obtaining fluid from a subsurface formation penetrated by a wellbore, comprising:

positioning a downhole tool in a wellbore, the tool having a sample chamber with a piston slidably positionable therein, the piston defining a sample cavity and a buffer cavity;

establishing fluid communication between the formation, the sample cavity and the buffer cavity whereby pressure is equalized therebetween;

flushing fluid from the sample cavity to the wellbore;

terminating fluid communication with the buffer cavity; and inducing flow of fluid into the sample chamber whereby a sample is collected.

* * * * *